US009820580B2

(12) United States Patent
Scarleski

(10) Patent No.: US 9,820,580 B2
(45) Date of Patent: Nov. 21, 2017

(54) FITTINGS FOR A BOX SPRING

(71) Applicant: Levitation Sciences LLC, Chicago, IL (US)

(72) Inventor: William J. Scarleski, Chicago, IL (US)

(73) Assignee: LEVITATION SCIENCES LLC, Chicago, IL (US)

( * ) Notice: Subject to any disclaimer, the term of this patent is extended or adjusted under 35 U.S.C. 154(b) by 0 days.

(21) Appl. No.: 14/918,415

(22) Filed: Oct. 20, 2015

(65) Prior Publication Data

US 2016/0242557 A1 Aug. 25, 2016

Related U.S. Application Data

(60) Provisional application No. 62/072,138, filed on Oct. 29, 2014, provisional application No. 62/065,937, filed on Oct. 20, 2014.

(51) Int. Cl.

| | |
|---|---|
| ***A47C 19/02*** | (2006.01) |
| ***A47C 21/00*** | (2006.01) |
| ***A47C 21/06*** | (2006.01) |
| ***A47C 27/08*** | (2006.01) |

(52) U.S. Cl.

CPC ..... *A47C 19/02* (2013.01); *A47C 19/025* (2013.01); *A47C 21/00* (2013.01); *A47C 21/06* (2013.01); *A47C 27/081* (2013.01)

(58) Field of Classification Search

CPC ..... A47C 19/02
USPC ..... 5/421, 423, 724, 726, 706, 710
See application file for complete search history.

(56) References Cited

U.S. PATENT DOCUMENTS 2,493,067 A * 1/1950 Goldsmith ..... A47C 21/044 219/217

* cited by examiner

*Primary Examiner* — Fredrick Conley
(74) *Attorney, Agent, or Firm* — John S. Paniaguas; Clark Hill PLC

(57) ABSTRACT

The present invention relates to fittings and an interior conduit to providing a continuous air flow path from a vertical wall of the box spring to a horizontal surface of the box spring to selectively supply to an inflatable volume integrated into a top surface of the box spring. Fittings are provided on a vertical wall for connection to an external source of air. Another set of fittings are provided on a top surface of the box spring for connection to an inflatable bladder. A conduit inside the box spring is connected to an interior nozzle on each of the fittings to provide a continuous flow path from the fittings on the vertical to the fittings on the horizontal surface. The side wall fittings allow an external source of air to be supported or alternatively provide a stable connection for a conduit. With such a configuration, a mattress being supported by a box spring can be maneuvered under the influence of the inflatable bladder without affecting the external source of air.

21 Claims, 50 Drawing Sheets

Side Support Plate_Machined

Side Support Plate

Side Support Plate

FITTINGS FOR A BOX SPRING

CROSS REFERENCE TO RELATED APPLICATIONS

This application claims the benefit of and priority to U.S. Provisional Patent Application No. 62/065,937, filed on Oct. 20, 2014 and U.S. patent application Ser. No. 62/072,138, filed on Oct. 29, 2014, hereby incorporated by reference.

BACKGROUND OF THE INVENTION

1. Field of the Invention

The present invention relates to a box spring for supporting a mattress and more particularly to fittings for enabling a box spring to accommodate an inflatable air bladder.

2. Description of the Prior Art

Various systems are known for utilizing an inflatable air volume disposed between mattress and a box spring or platform for facilitating maneuvering of the mattress relative to the box spring. An example of such a system is disclosed in U.S. Pat. No. 8,006,331. Various embodiments are disclosed in the '331 patent. In one embodiment the inflatable air volume is incorporated into a cover which is attached to an underside of the mattress and inflated in order to facilitate maneuvering of the mattress. In yet another embodiment, the inflatable volume is integrated into an encasement which encases the mattress. In that embodiment, the inflatable air volume is disposed on the underside of the mattress as well. Finally, in a third embodiment, the inflatable air volume is integrated into an underside of a mattress In all three embodiments, a conduit is attached to the inflatable air volume on one end and an air supply is connected to the opposing end of the conduit. In such configurations, since the air supply and the conduit are all connected to the mattress, any maneuvering of the mattress, for example, rotation, will cause the air supply and the conduit to be maneuvered as well.

As such, it would be useful to build the conduits for the air supply directly into the foundation. Unfortunately, the current configuration of a box spring does not provide a rigid vertical surface that can provide a stable connection for an air supply conduit. In particular, the current configuration of a box spring is illustrated in FIGS. 1A and 1B. As shown, the box spring, generally identified with the reference numeral 20, includes a wood frame, generally identified with the reference numeral 22. The box spring 20 also includes a plurality of wire frames, generally identified with the reference numeral 24. The wire frames 24 are stapled to cross members 26 of the wood frame 22 and connected together by a plurality of traverse rods 28 that extend the width of the box spring 20. The assembled box spring is covered with a cover 30 which is stapled on the ends to the underside of the cross members 26. The vertical walls of the box spring 20 are formed by the cover 30. The cover 30 may be formed from a cover material and an insulating material. The cover 30 includes a top panel and the vertical walls. As such the vertical walls of the box spring 20 are soft surfaces and are incapable of providing a stable surface for connection to a conduit or for supporting an external source of air.

Thus, there is a need for providing a stable surface on the vertical walls of the box spring 20 to provide a stable surface for connecting a conduit so that an inflatable bladder can be incorporated into the box spring 20 to provide a configuration in which the mattress (not shown) can be maneuvered with respect to the box spring 20 without affecting the conduit and air supply.

SUMMARY OF THE INVENTION

The present invention relates to fittings and an interior conduit to provide a continuous air flow path from a vertical wall of the box spring to a horizontal surface of the box spring to selectively supply air to an inflatable volume integrated into a top surface of the box spring. Fittings are provided on a vertical wall for connection to an external source of air. Another set of fittings are provided on a top surface of the box spring for connection to an inflatable bladder. A conduit inside the box spring is connected to an interior nozzle on each of the fittings to provide a continuous air flow path from the fittings on the vertical to the fittings on the horizontal surface and into an inflatable air volume. The side wall fittings allow an external source of air to be supported or alternatively provide a stable connection for a conduit. With such a configuration, a mattress being supported by a box spring can be maneuvered under the influence of the inflatable bladder without affecting the external source of air.

DESCRIPTION OF THE DRAWING

These and other advantages of the present invention will be readily understood with reference to the following specification and attached drawing wherein.

DETAILED DESCRIPTION

The present invention relates to fittings and an interior conduit to provide a continuous air flow path from an external source of air to an inflatable volume integrated into a top surface of the box spring. Fittings are provided on a vertical wall for connection to the external source of air. Another set of fittings are provided on a top surface of the box spring for connection to an inflatable bladder. A conduit inside the box spring is connected to an interior nozzle on each of the fittings to provide a continuous air flow path from the fittings on the vertical wall to the fittings on the horizontal surface and into an inflatable air volume. The side wall fittings allow an external conduit and/or air pump ("external source of air") to be supported or alternatively provide a stable connection therefor. With such a configuration, a mattress being supported by a box spring can be maneuvered under the influence of the inflatable bladder without affecting the external source of air.

Figure 12:
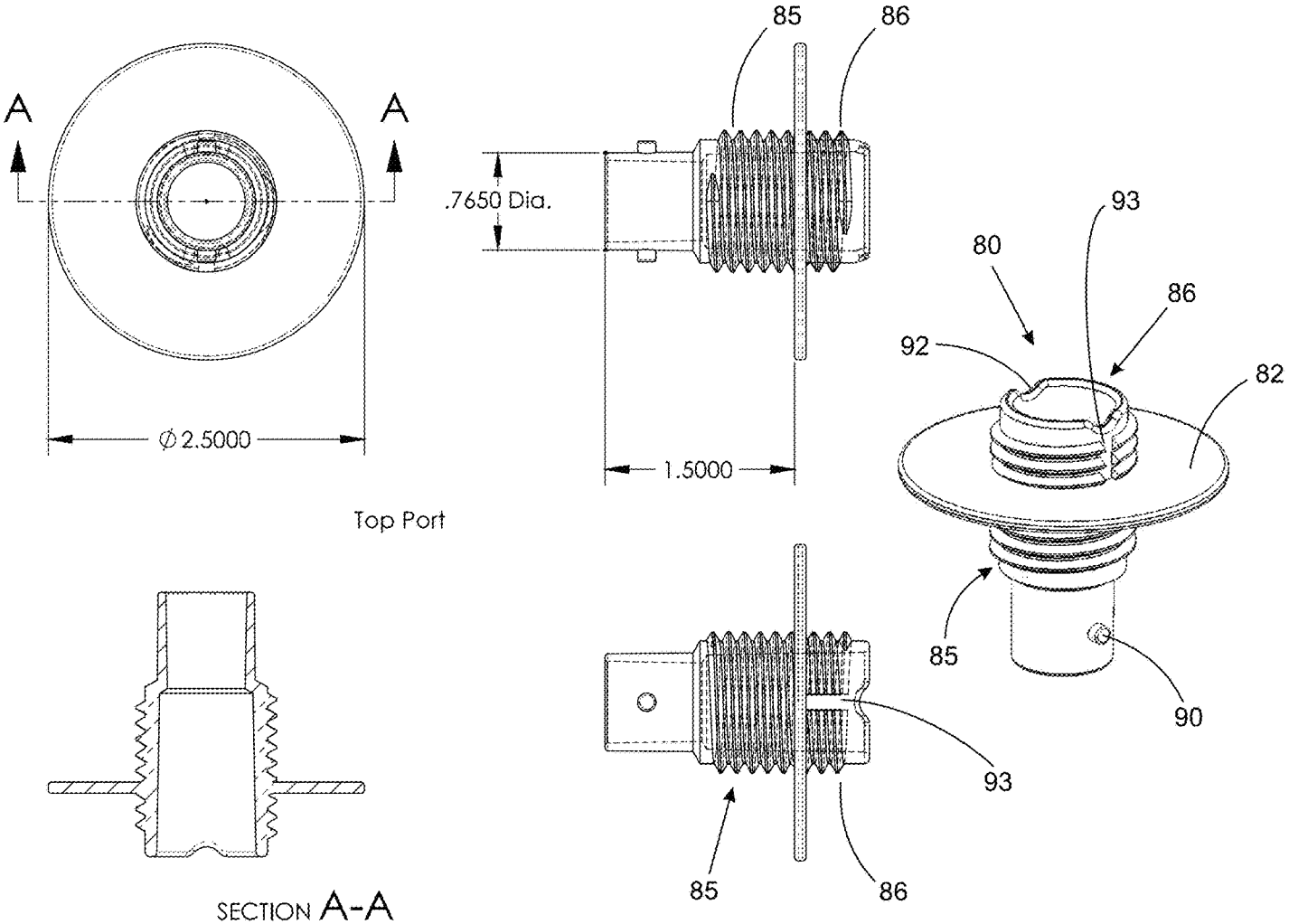
FIG. 12 illustrates various exemplary views of a nozzle which is one of the fittings connected to the top surface of the box spring.
Figure 13:
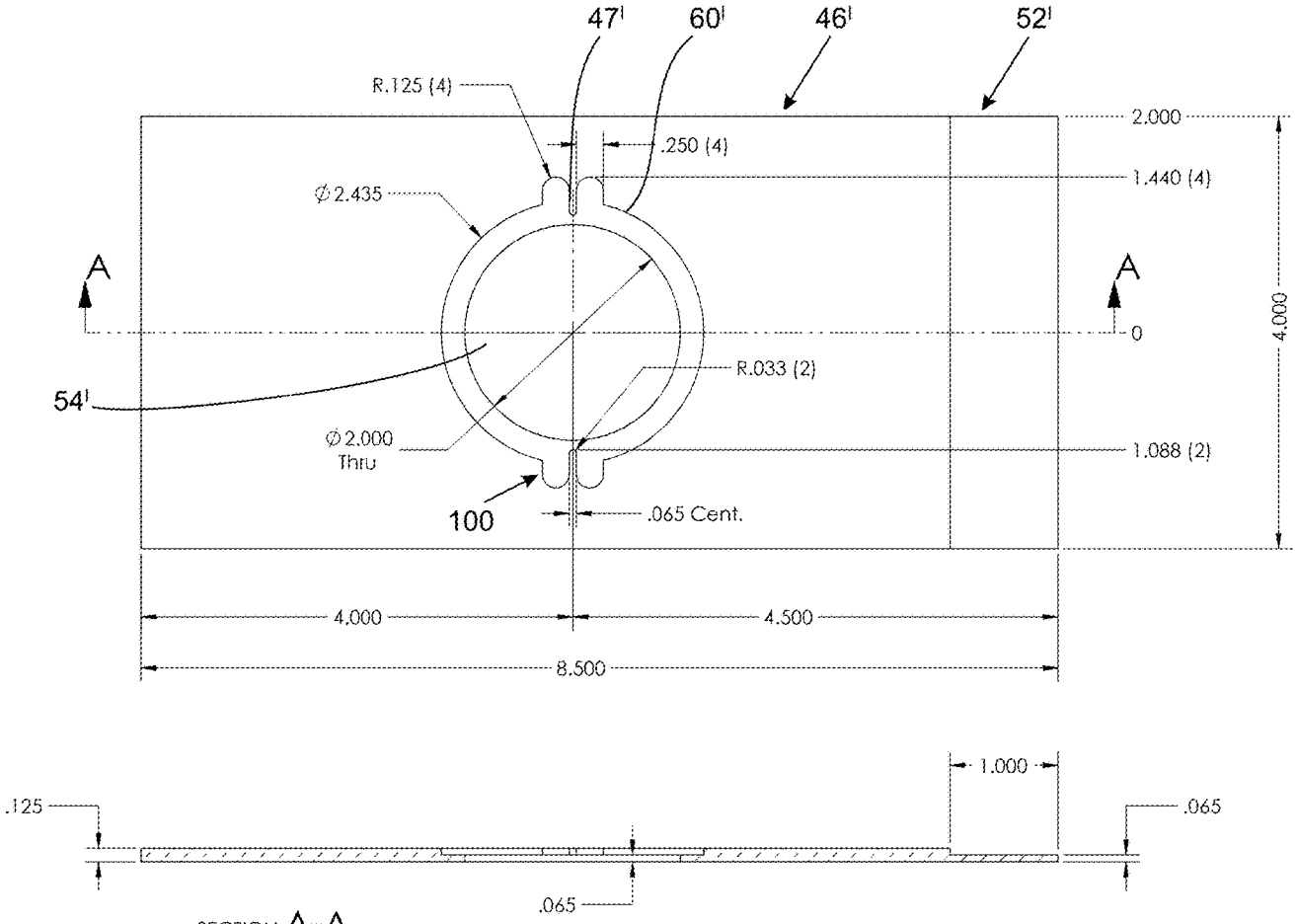
FIG. 13 illustrates an alternate method of machining the stiffener plate illustrated in FIG. 10.
Figure 14:
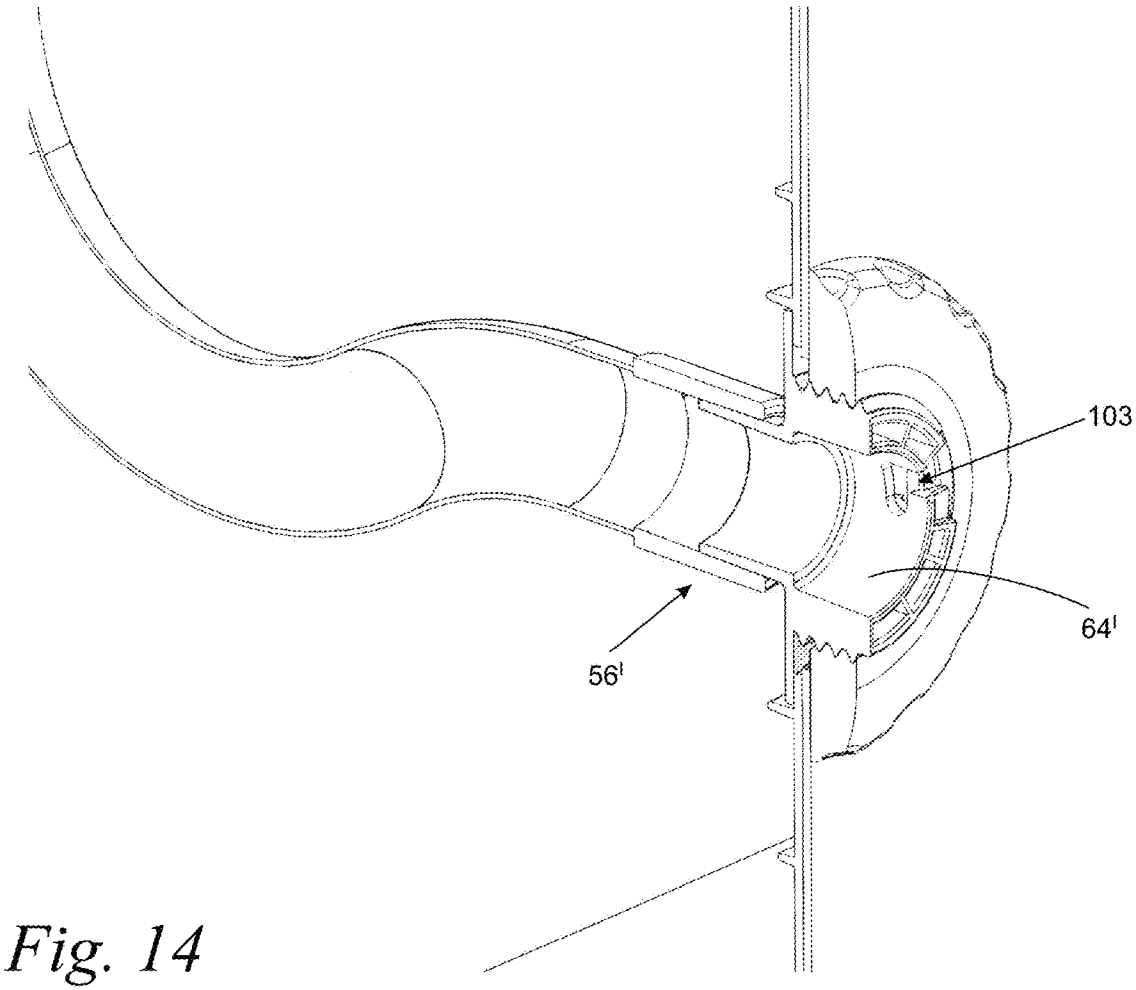
FIGS. 14 and 15 illustrate another alternate embodiment of the nozzle illustrated in FIG. 8.
Figure 15:
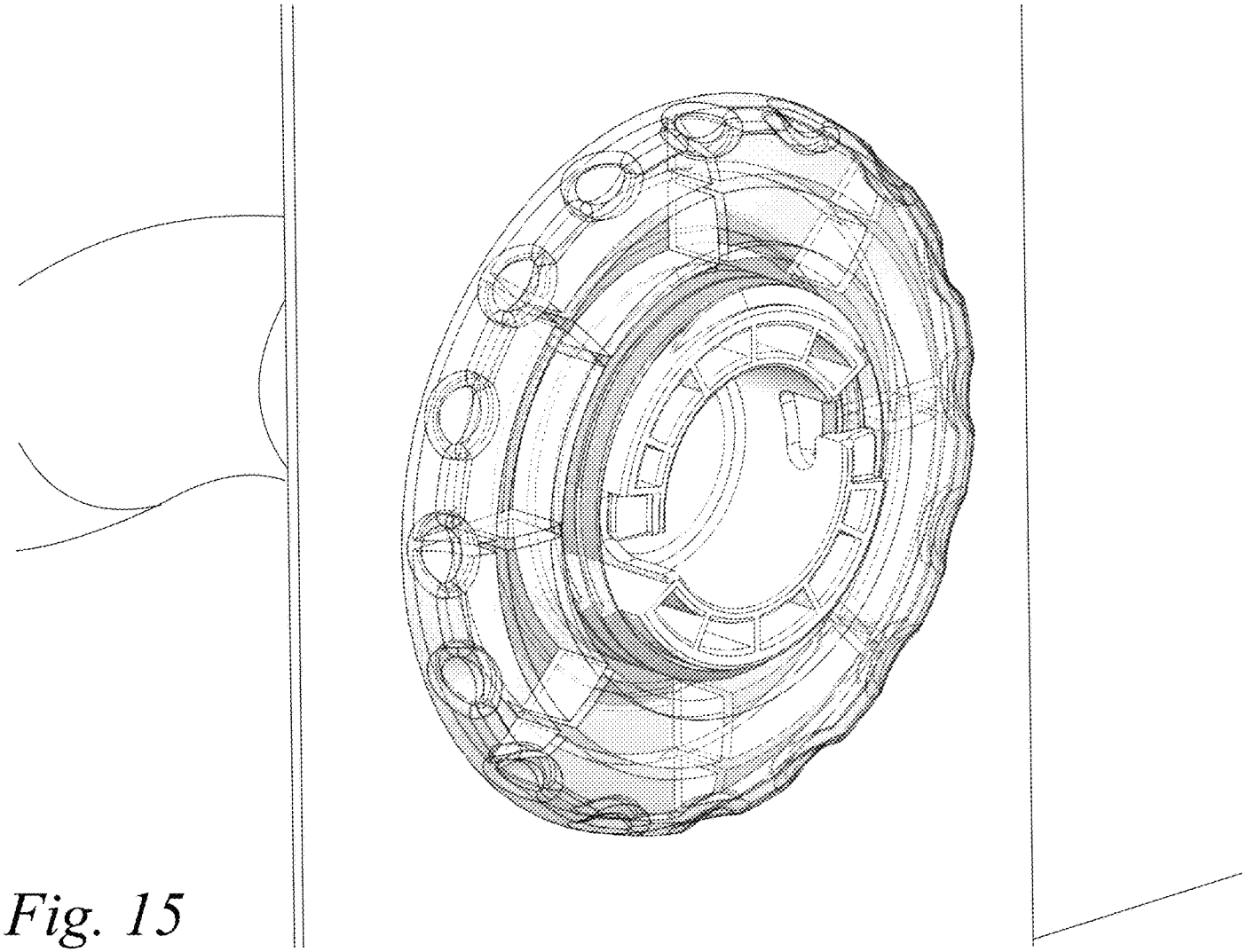
Figure 16:
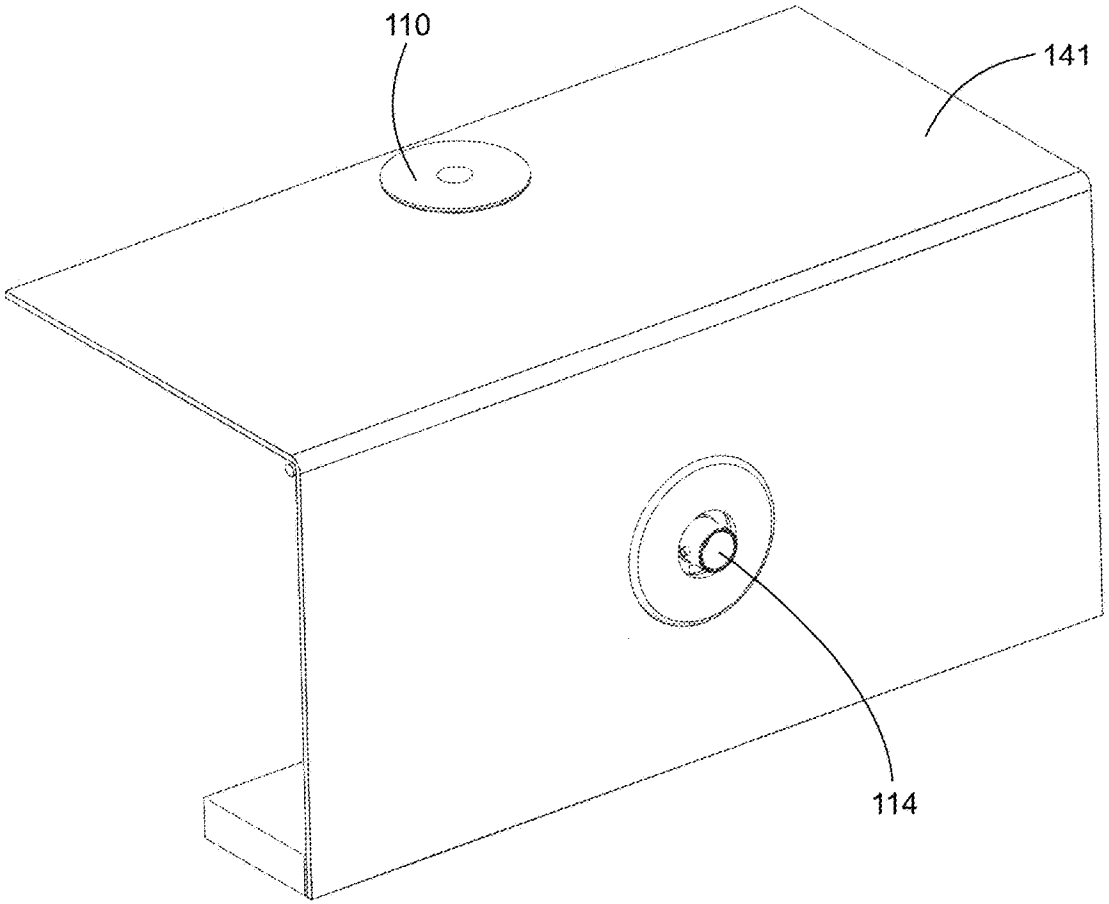
FIGS. 16-28 illustrate a yet another alternate embodiment of the invention in which the parts are ratcheted together.
Figure 17:
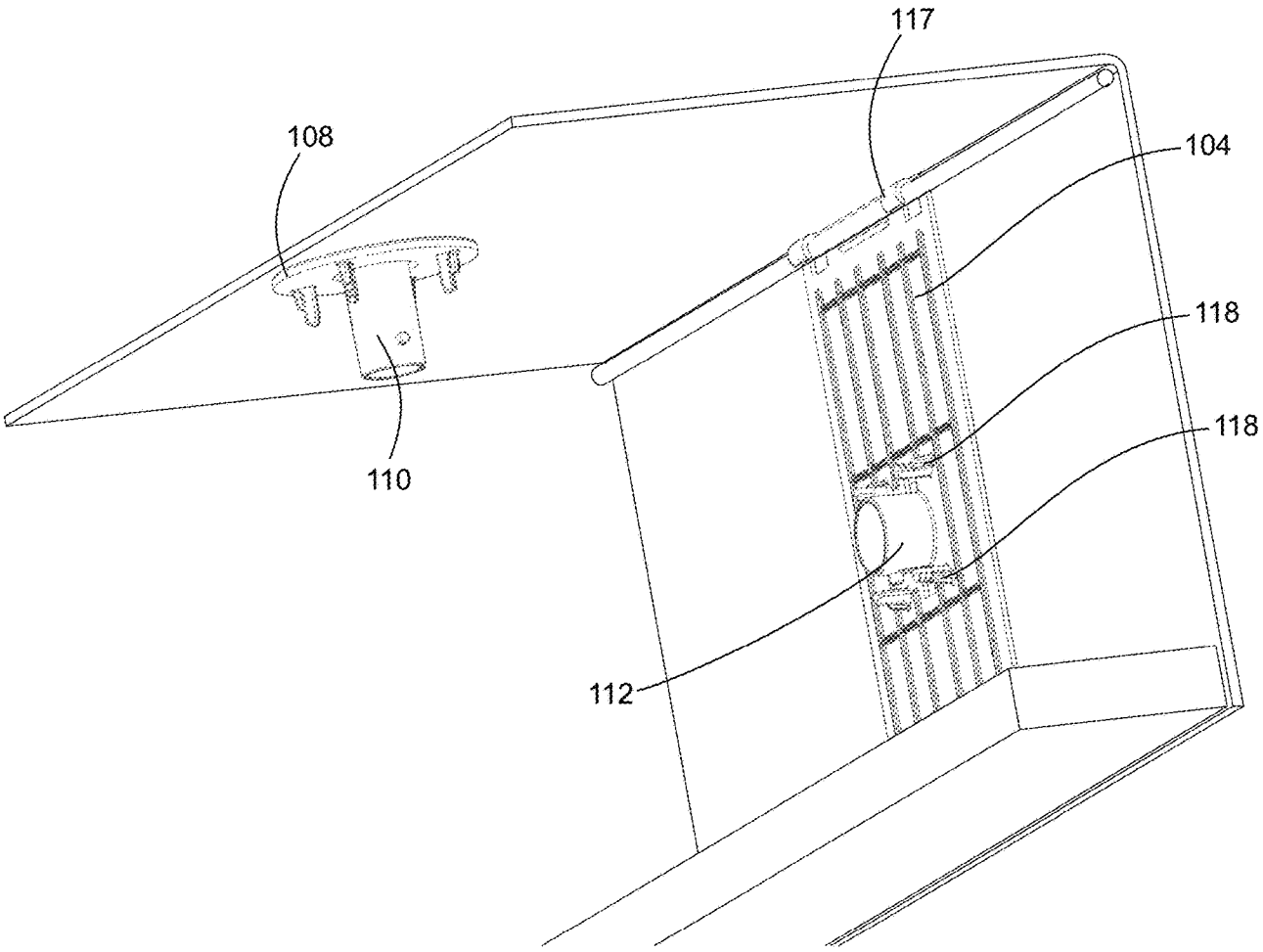
Figure 28:
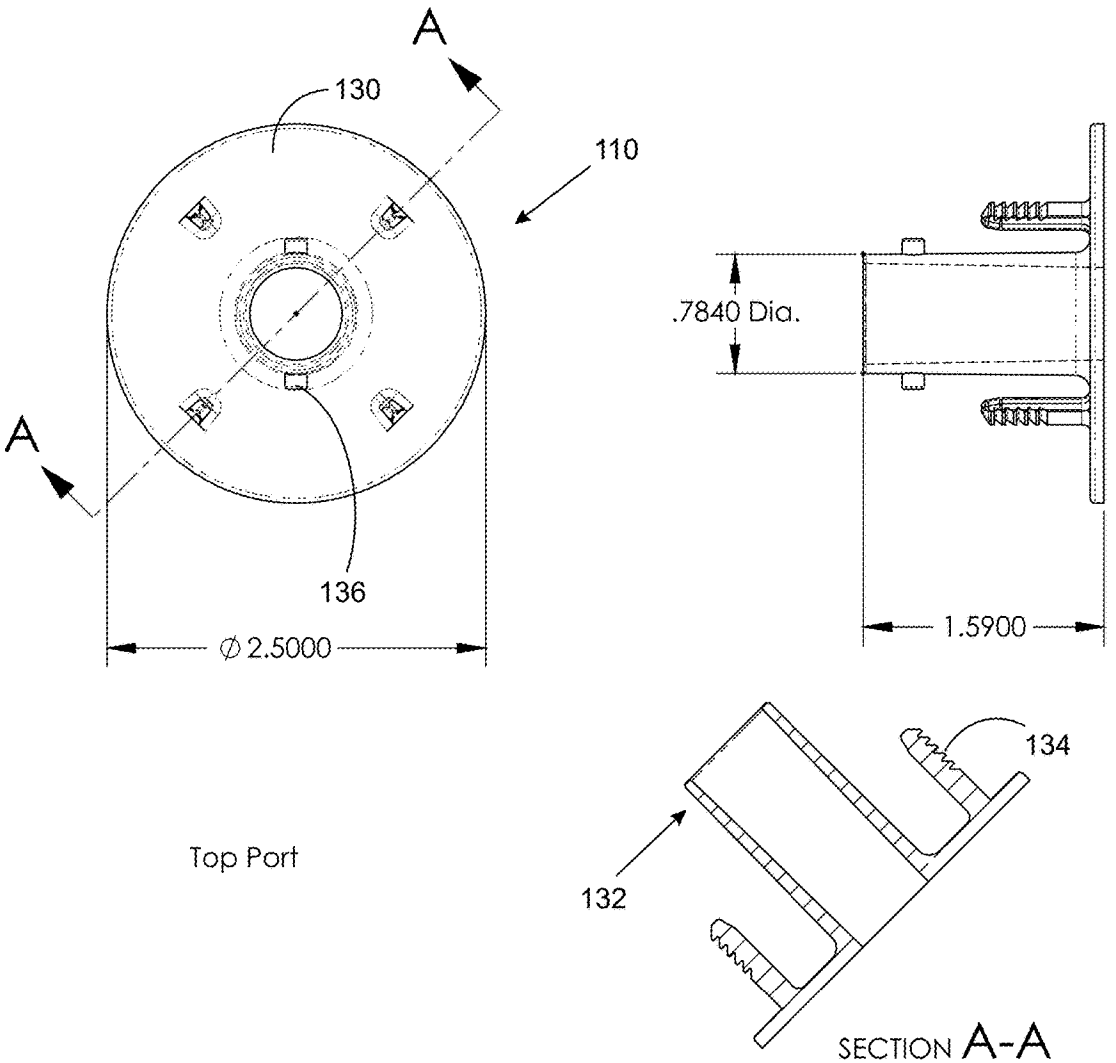
Figure 29:
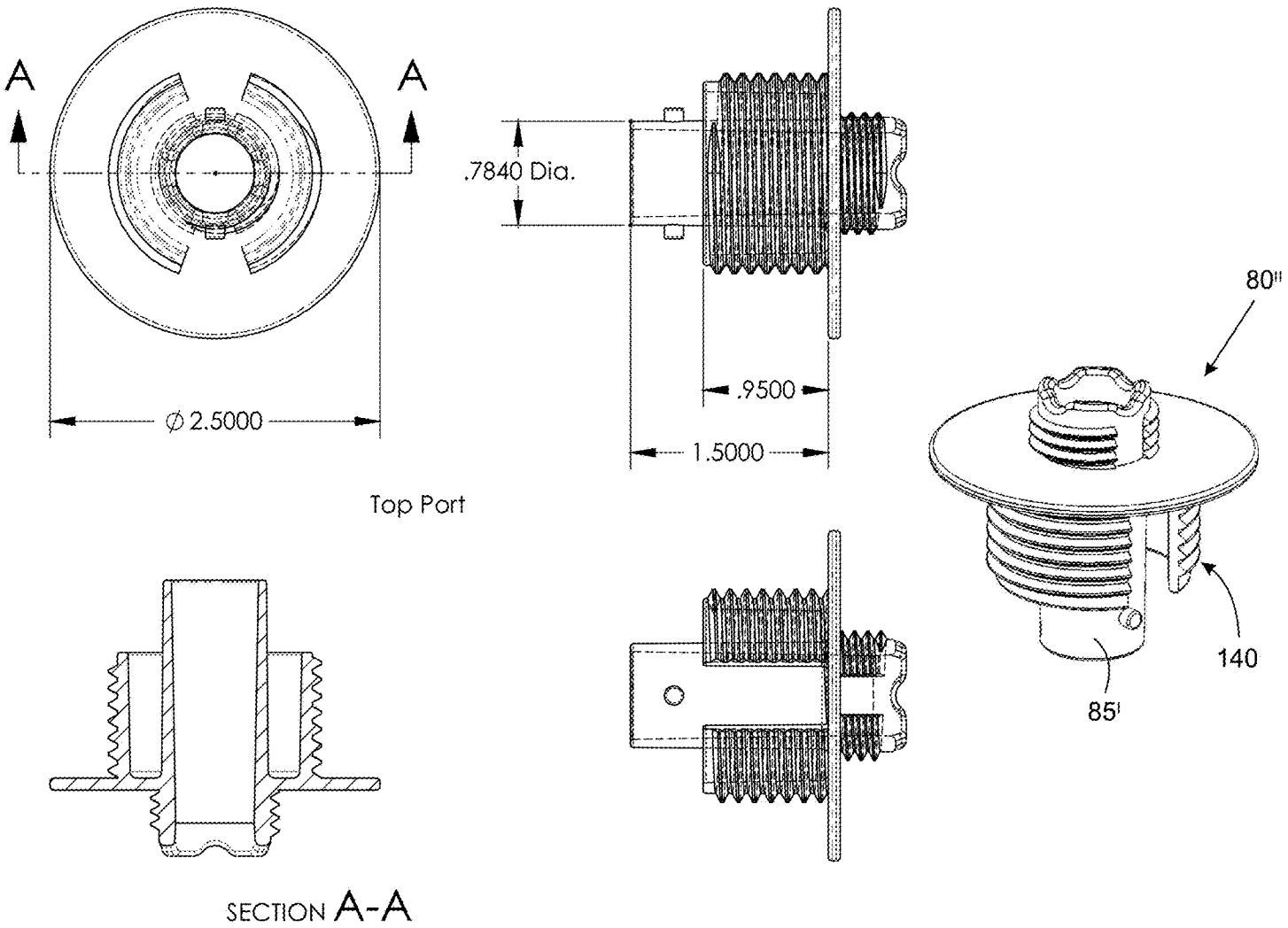
FIGS. 29 and 30 illustrate another embodiment of the invention.
Figure 30:
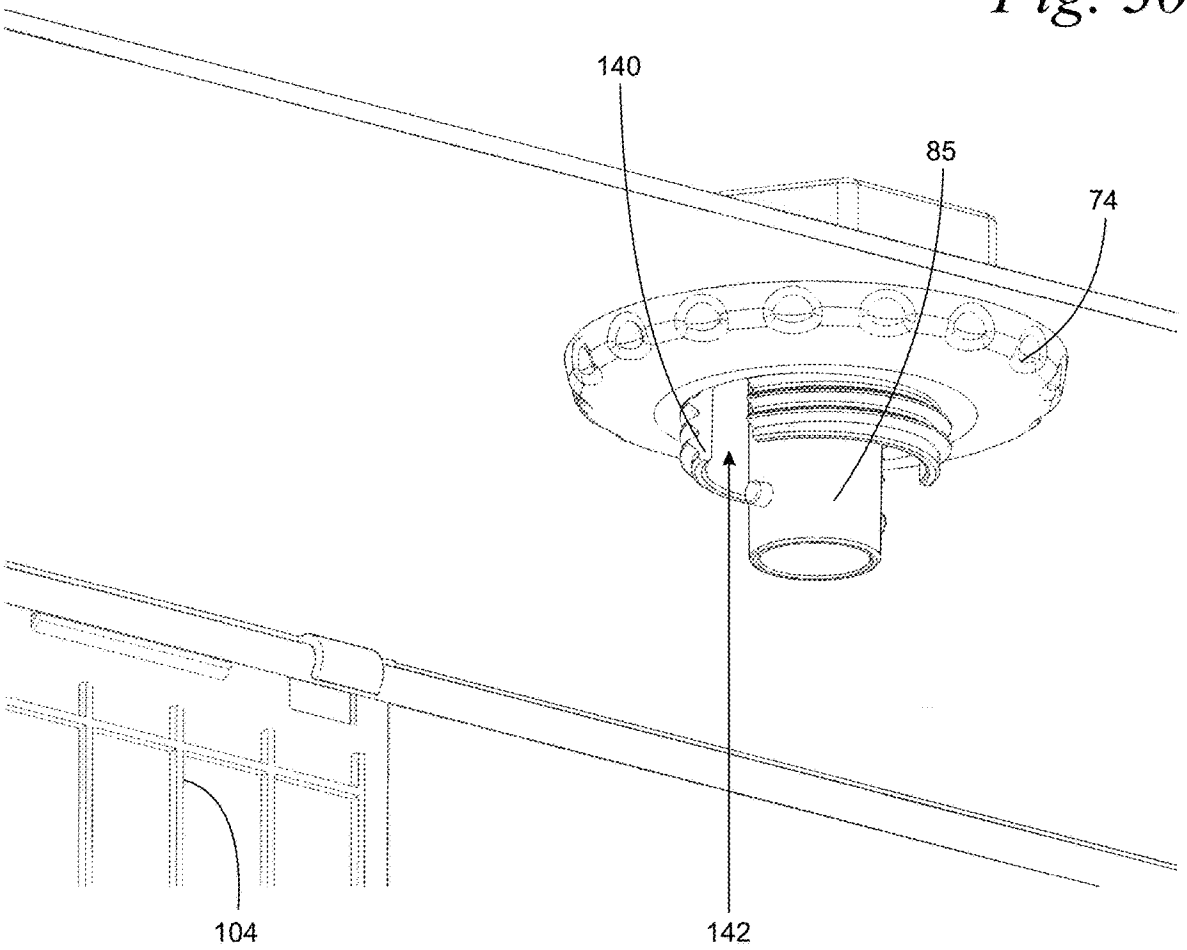
Figure 31:
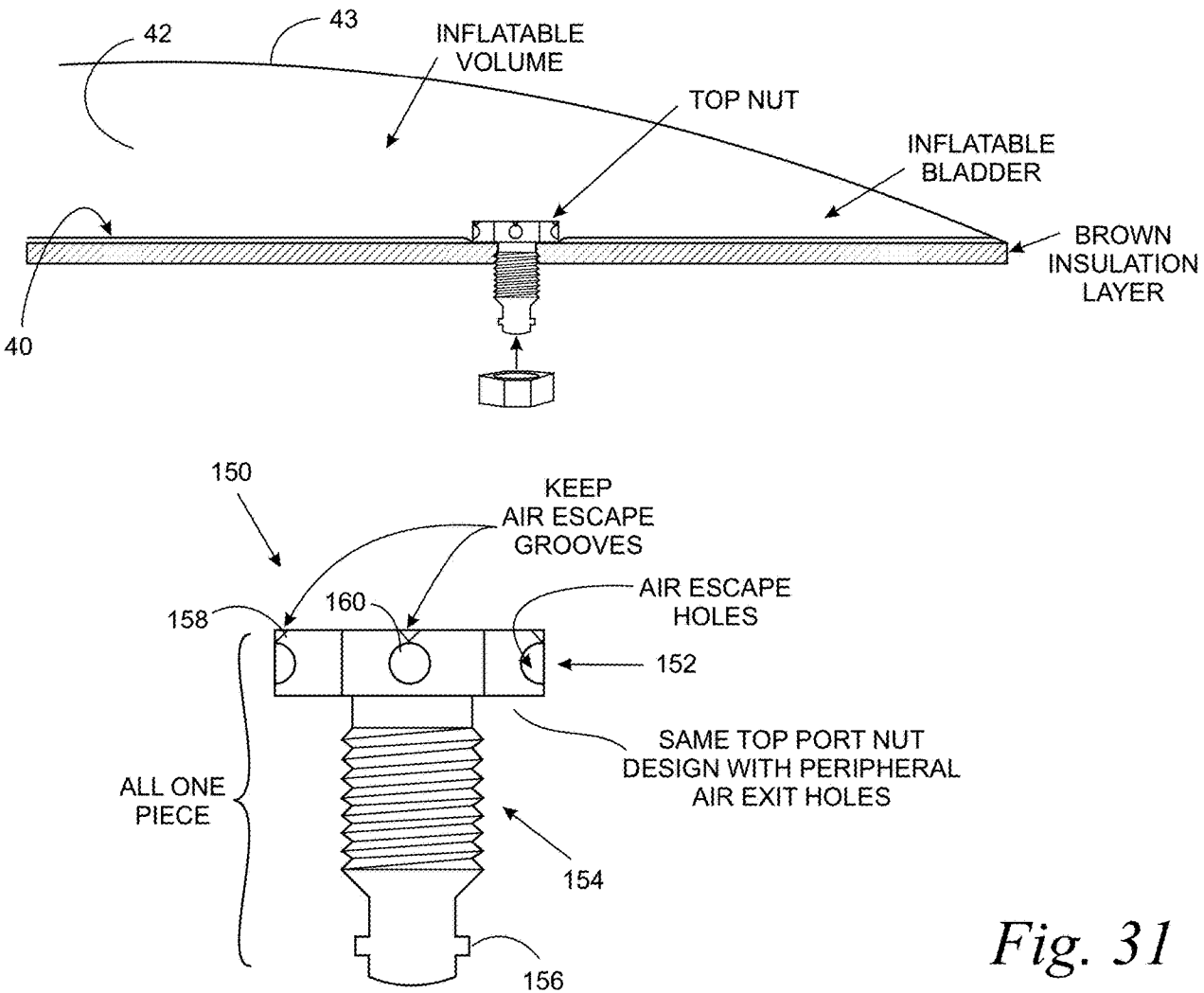
FIG. 31 illustrates another alternate embodiment of the invention.
Figure 32:
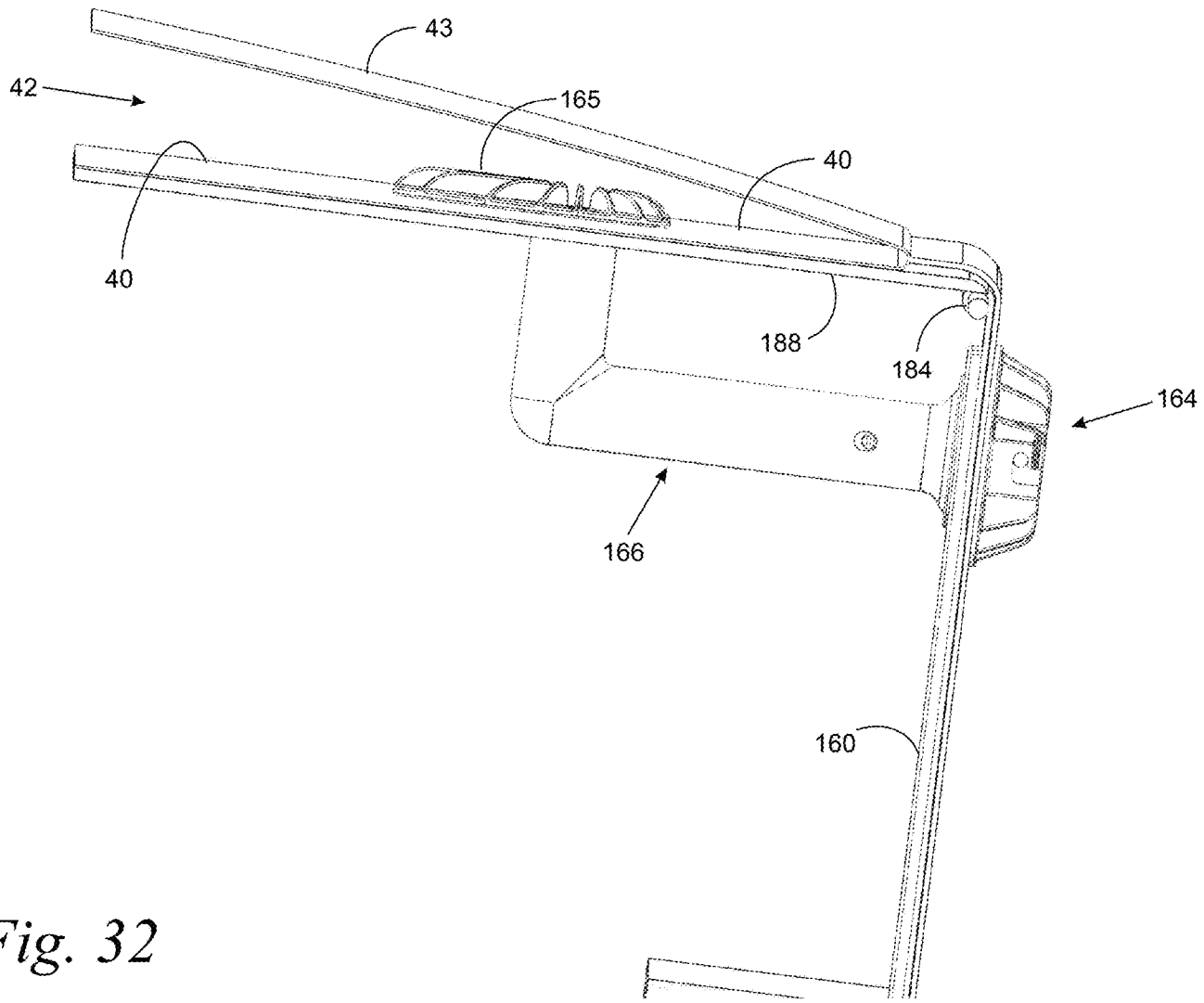
FIGS. 32-44 illustrate a three piece embodiment of the invention
Figure 33:
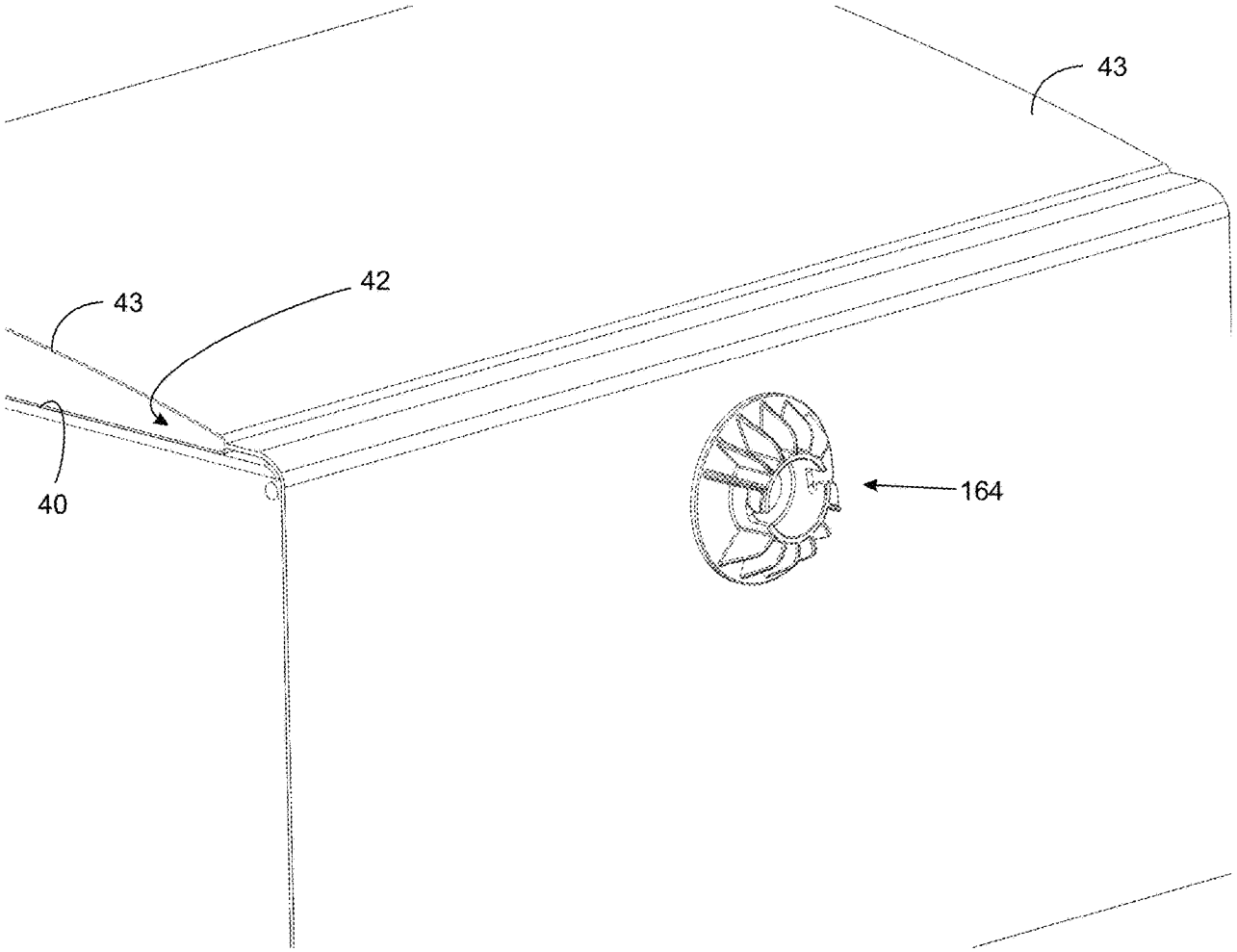
Figure 34:
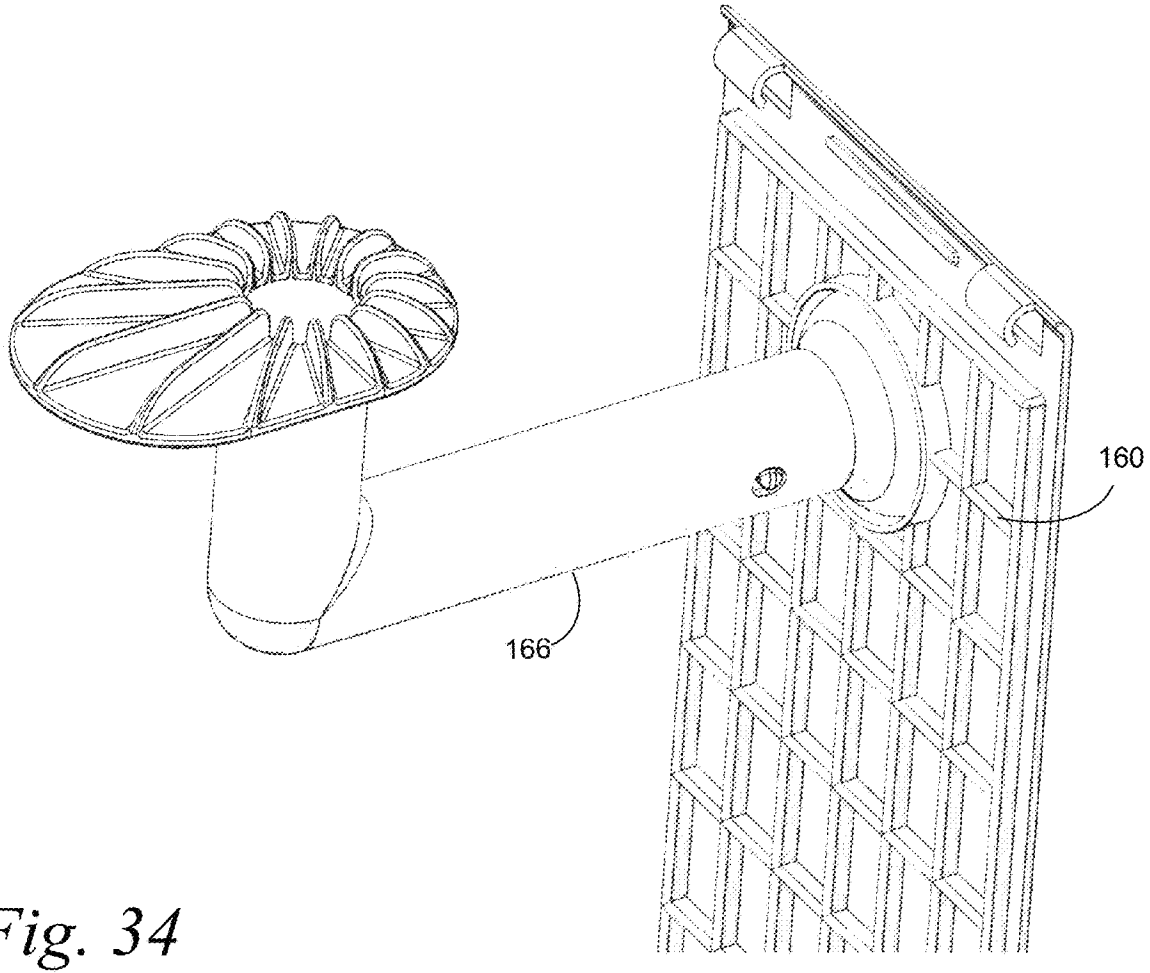
Figure 35:
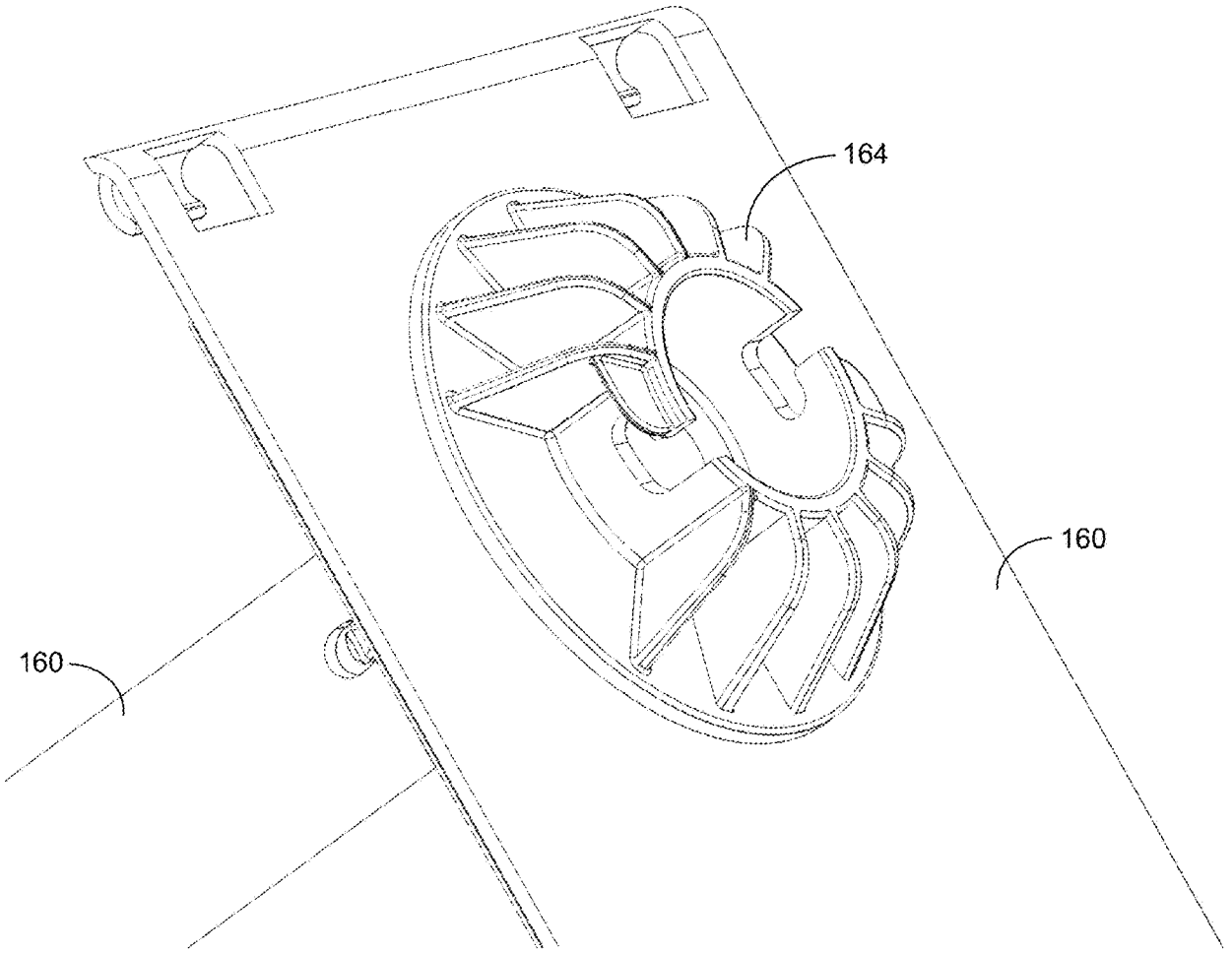
Figure 36:
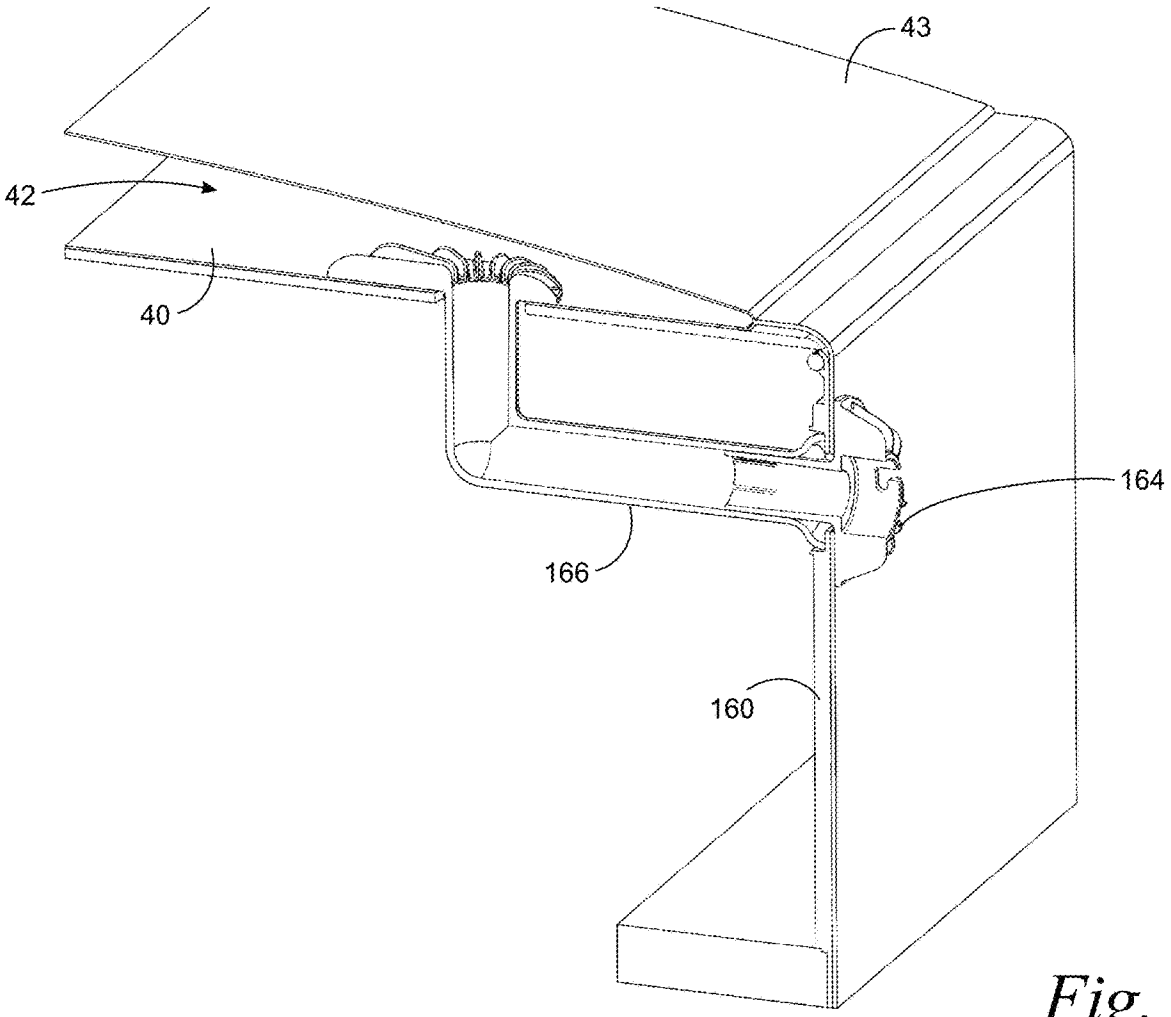
Figure 37:
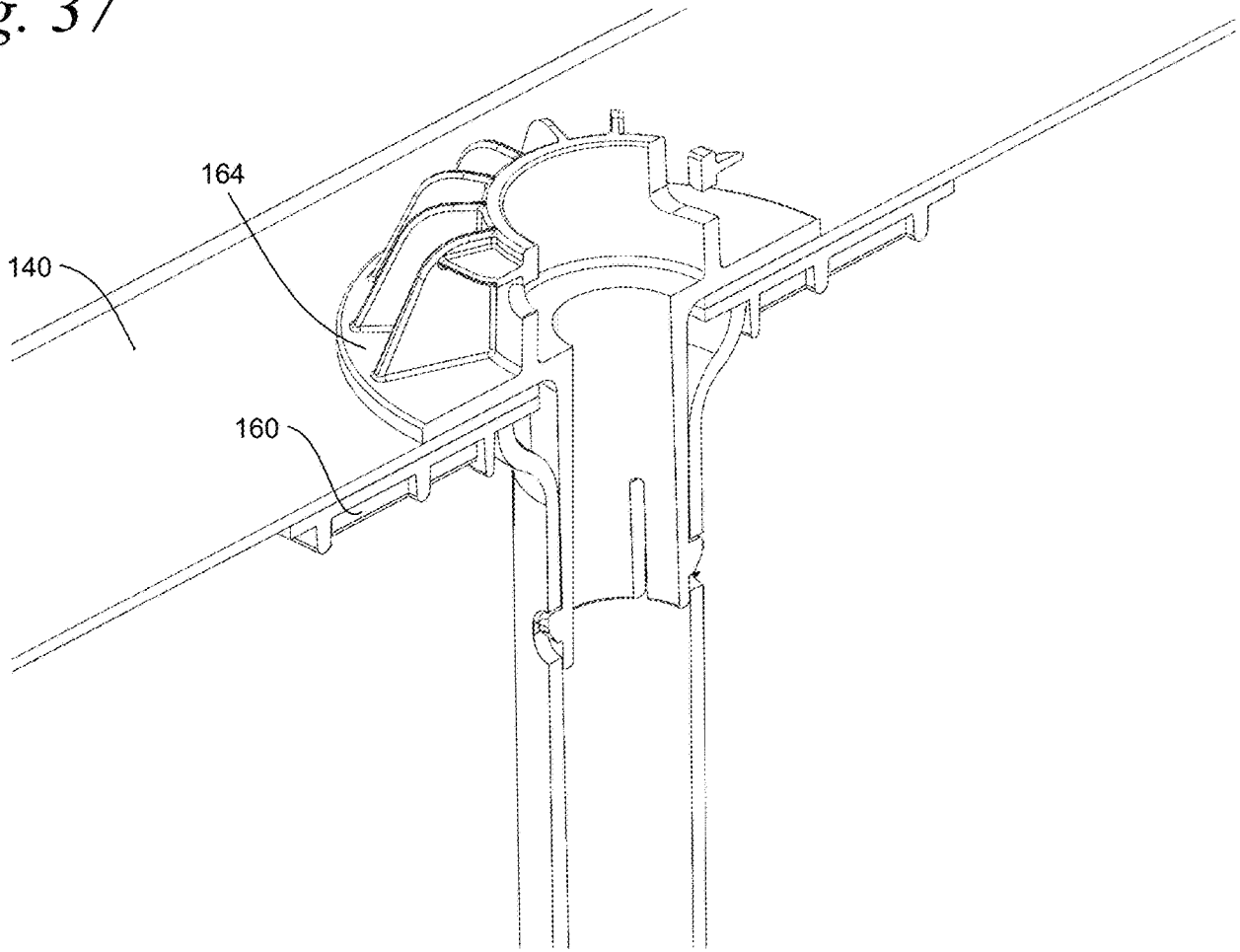
Figure 38:
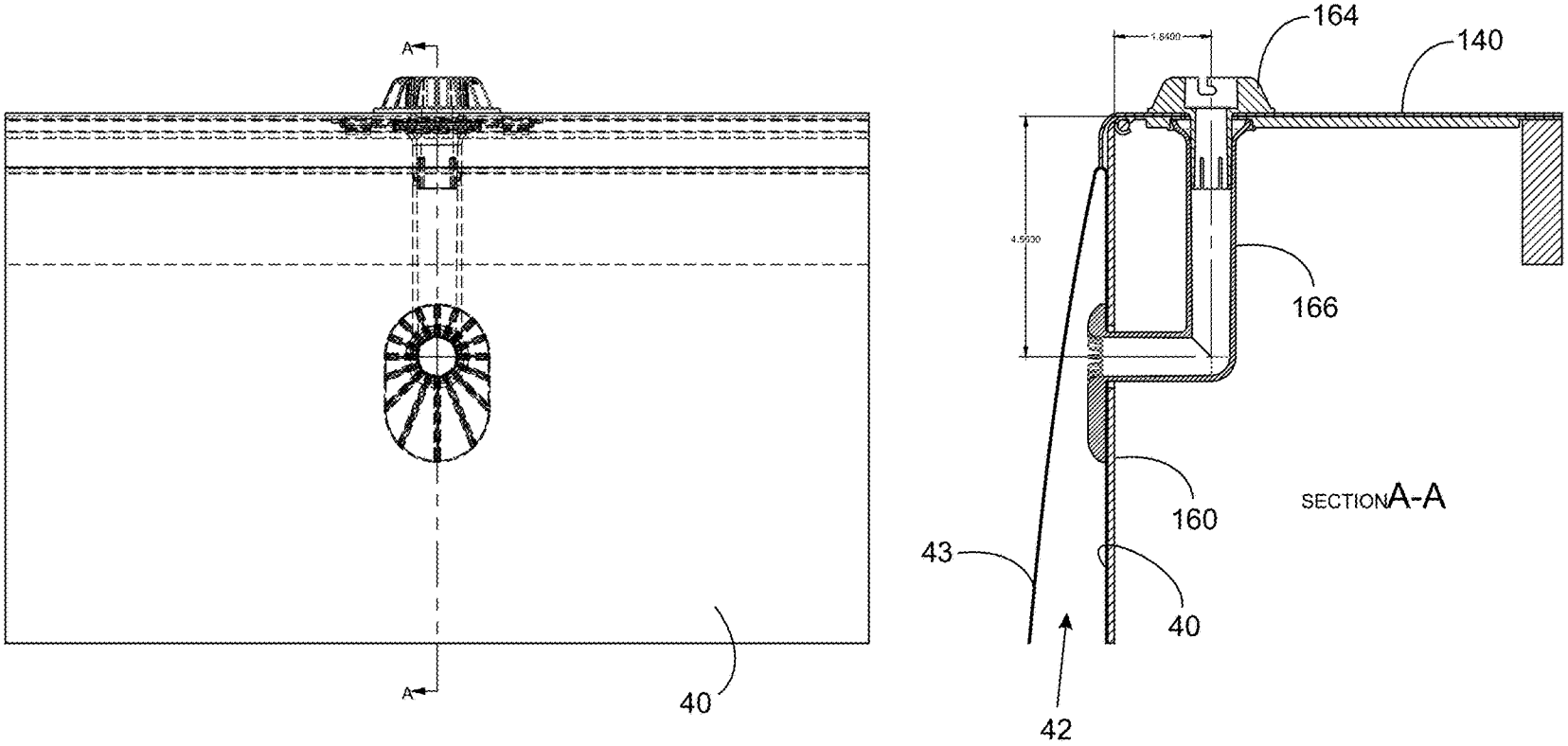

Various exemplary embodiments of the invention are illustrated. FIGS. 2-12 illustrate one embodiment of the invention. FIG. 13 illustrates an alternate embodiment of a stiffener plate that forms part of the invention FIGS. 14 and 15 illustrate another alternate embodiment of the invention. FIGS. 16-28 illustrate a yet another alternate embodiment of the invention. FIGS. 29 and 30 illustrate another alternate embodiment of the invention of a side wall fitting that forms part of the invention. FIG. 31 illustrates another alternate embodiment of the invention. FIGS. 32-44 illustrate another alternate embodiment of the invention. FIGS. 45-49 illustrate yet another embodiment of the invention.

Figure 2:
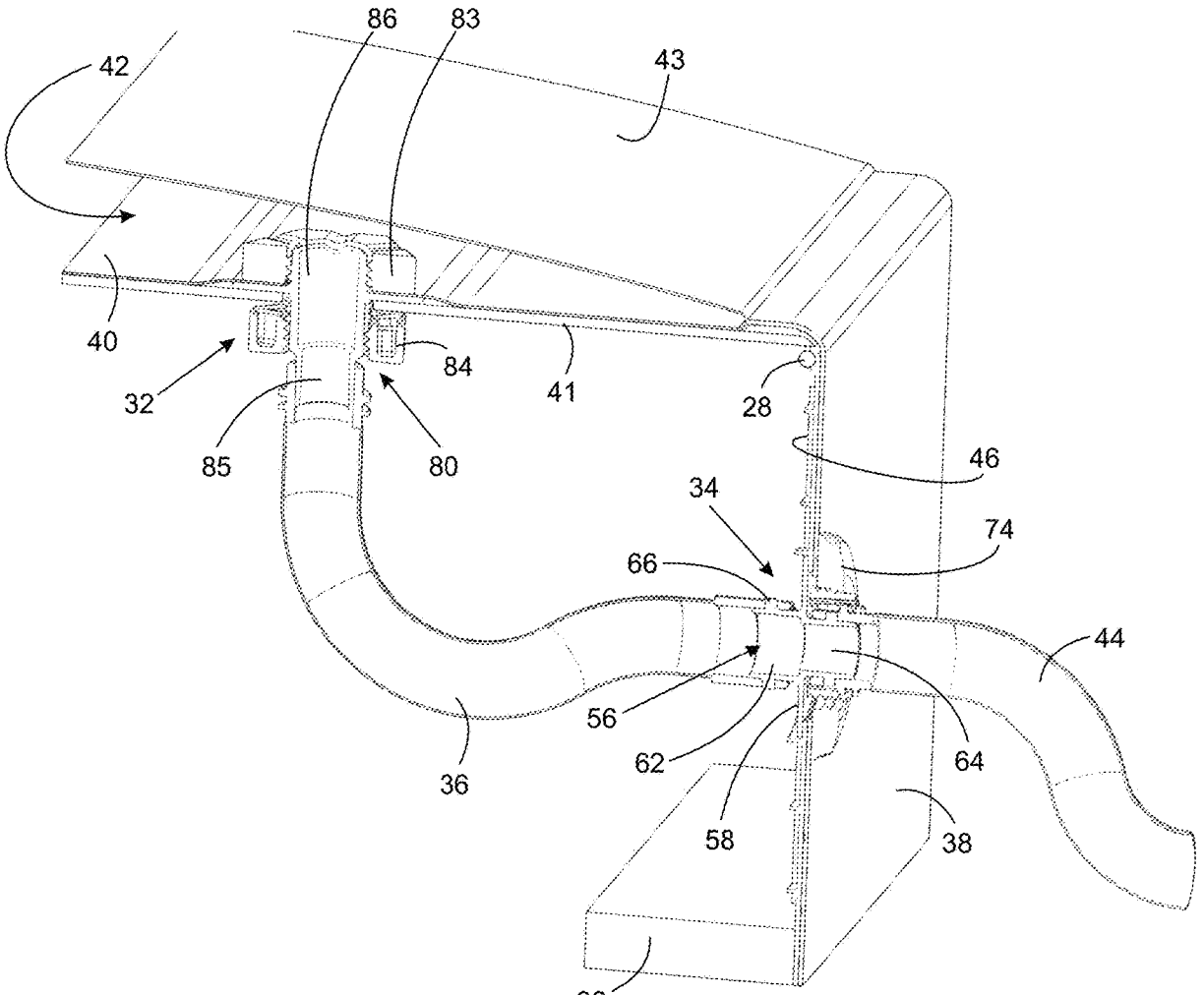
FIG. 2 is an isometric view, partially in section, of one embodiment of the invention illustrating the fittings and the interior conduit as it would be mounted into a box spring.
Figure 3:
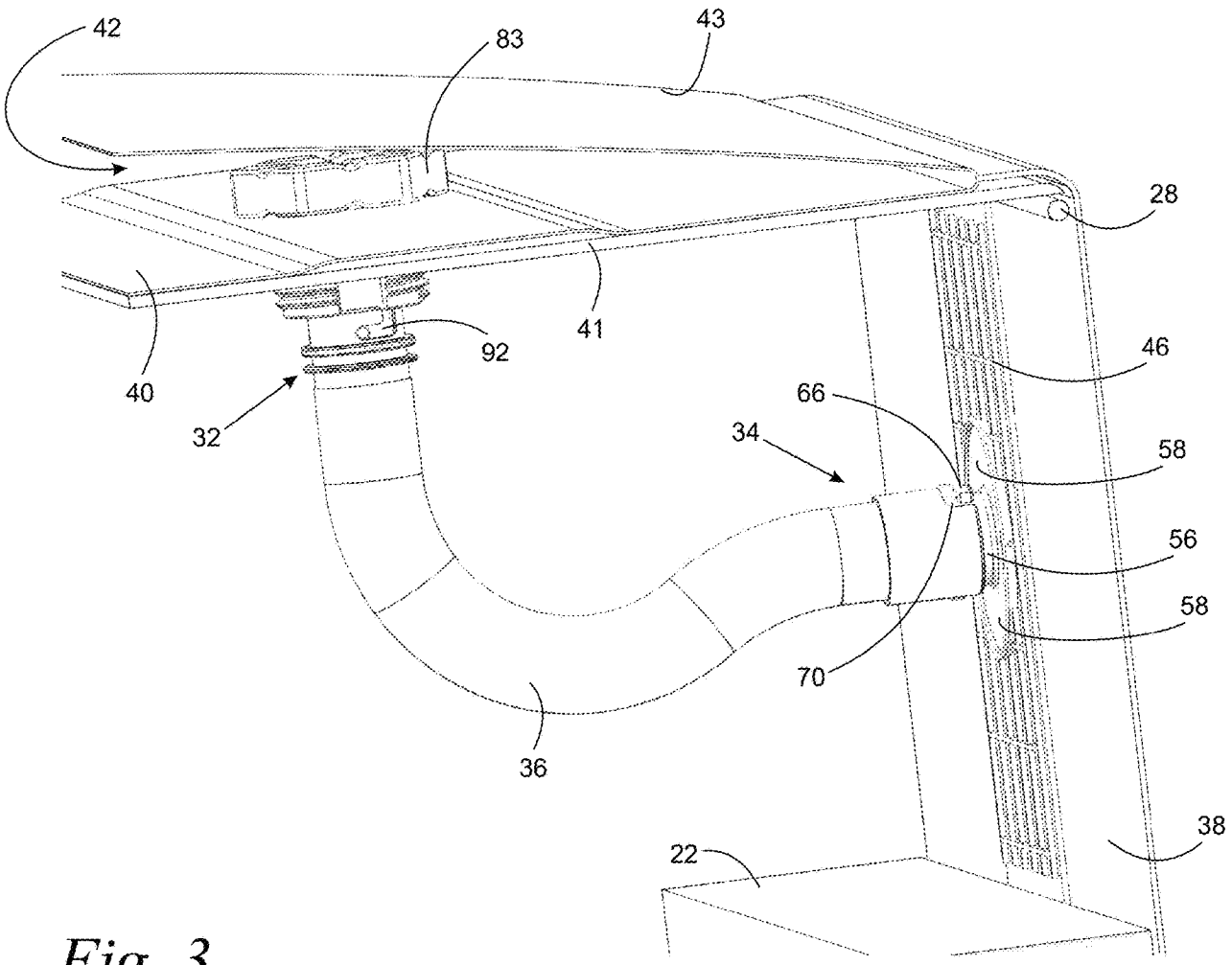
FIG. 3 is similar to FIG. 2 but at an angle which illustrates a vertical stiffener plate which forms a part of one embodiment of the invention.

Referring to FIGS. 2-12, one embodiment of the invention is illustrated. As illustrated in FIGS. 2 and 3, vertical wall fittings are provided for connecting an external source of air to a vertical wall of a box spring. Top surface fittings are provided for connecting a top surface of the box spring to an inflatable volume (not shown). FIGS. 4, 5 and 8-10 illustrate the vertical wall fittings while FIGS. 6, 7, 11, and 12 illustrate the top surface fittings.

Referring first to FIGS. 2 and 3, vertical side wall fittings and top fittings are connected to the box spring 20 (FIG. 1A) with an internal conduit connected therebetween to provide a continuous air path between the vertical wall fittings and the top surface fittings and an external source of air (not shown). More particularly, the vertical side wall fittings, generally identified with the reference numeral 34, and the top surface fittings, generally identified with the reference numeral 32, are used to connect a conduit 36 from a vertical sidewall 38 of a box spring 20 to a bottom layer 40 of an inflatable volume on top of the box spring 20. As shown in FIGS. 2 and 3, the top fittings 32 are partially disposed within an inflatable volume, partially shown in section and identified with the reference numeral 42. An exemplary inflatable volume is described in detail in Scarleski U.S. Pat. No. 8,006,331, hereby incorporated by reference.

An external conduit 44 may be connected on one end to an external side of the vertical sidewall fitting 34 and on an opposing end to an external source of air (not shown). The external conduit 44 may be used to provide an air flow path from the external source of air (not shown) to the fittings 32 and 34 and ultimately into the inflatable volume 42. Alternatively, an external air pump (not shown) may be connected directly to the vertical sidewall fitting 34. Both configurations allow the inflatable volume 42 to be selectively inflated, as set forth in the '331 patent, in order to rotate or otherwise maneuver or levitate a mattress (not shown) relative to the inflatable volume on the surface of the foundation, box spring or platform.

Figure 10:
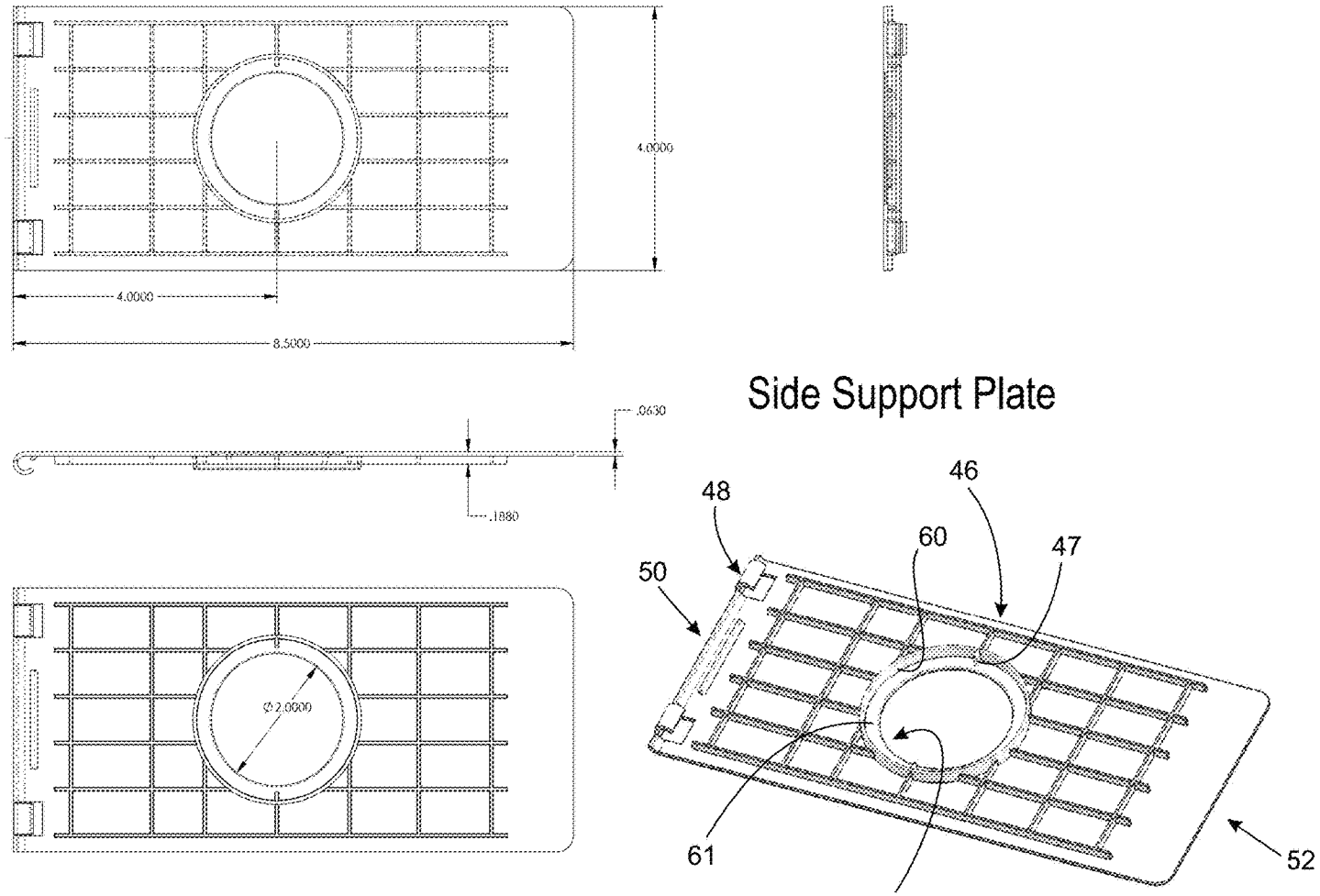
FIG. 10 illustrates various exemplary views of a stiffener plate used to stiffen the vertical side wall of a box spring.

Turning to FIG. 10, the vertical sidewall fittings 34 include a stiffener plate 46. The vertical walls 38 of the box spring 20 are soft and made of fabric and insulation and thus are not suitable for providing a stable connection to an external conduit 44 (FIG. 2) or for supporting an external air pump (not shown). An exemplary configuration for attaching the stiffener plate 46 to the vertical side wall 38 (FIG. 3) is shown in FIG. 10. As shown, the stiffener plate 46 includes one or more curled tabs 48 on one end 50. The opposing end 52 is flat and may have a reduced thickness. The curled tabs 48 are used to capture a traverse rod 28 (FIG. 1A) of the box spring 20 to secure one end 50 (FIG. 10) of the stiffener plate 46 (FIG. 10). The opposing end 52 of the stiffener plate 46 is attached to the wood frame 22 (FIGS. 1A-3) of the box spring 20, for example, by way of one or more fasteners (not shown), such as staples.

The stiffener plate 46 as welt as the balance of the fittings described herein may be formed from a rigid plastic material. The stiffener plate 46 may be formed with an aperture 54 (FIG. 10). The aperture 54 is formed to receive a vertical wall nozzle 56, as shown best in FIG. 8. The nozzle 56 includes a flange portion 58 that is configured to be received in the aperture 54 in the stiffener plate 46 (FIG. 10). An annular wall 60 spaced away from the aperture 54 and forms an annular stop 61 for capturing the flange portion 58 (FIG. 8) of the nozzle 56.

In order to prevent the nozzle 56 from rotating, the stiffener plate 46 (FIG. 10) is provided with one or more radial inward tabs 47 extending from the annular wall 60. These radial tabs 47 extend in a radial direction from the annular wall 60 to the aperture 54. These radial tabs 48 are received in notches 68 (FIG. 8) formed in a flange portion 58 of the vertical wall nozzle 56. This configuration prevents axial rotation of the vertical wall nozzle 56 within the aperture 54 (FIG. 10) in the stiffener plate 46.

Figure 8:
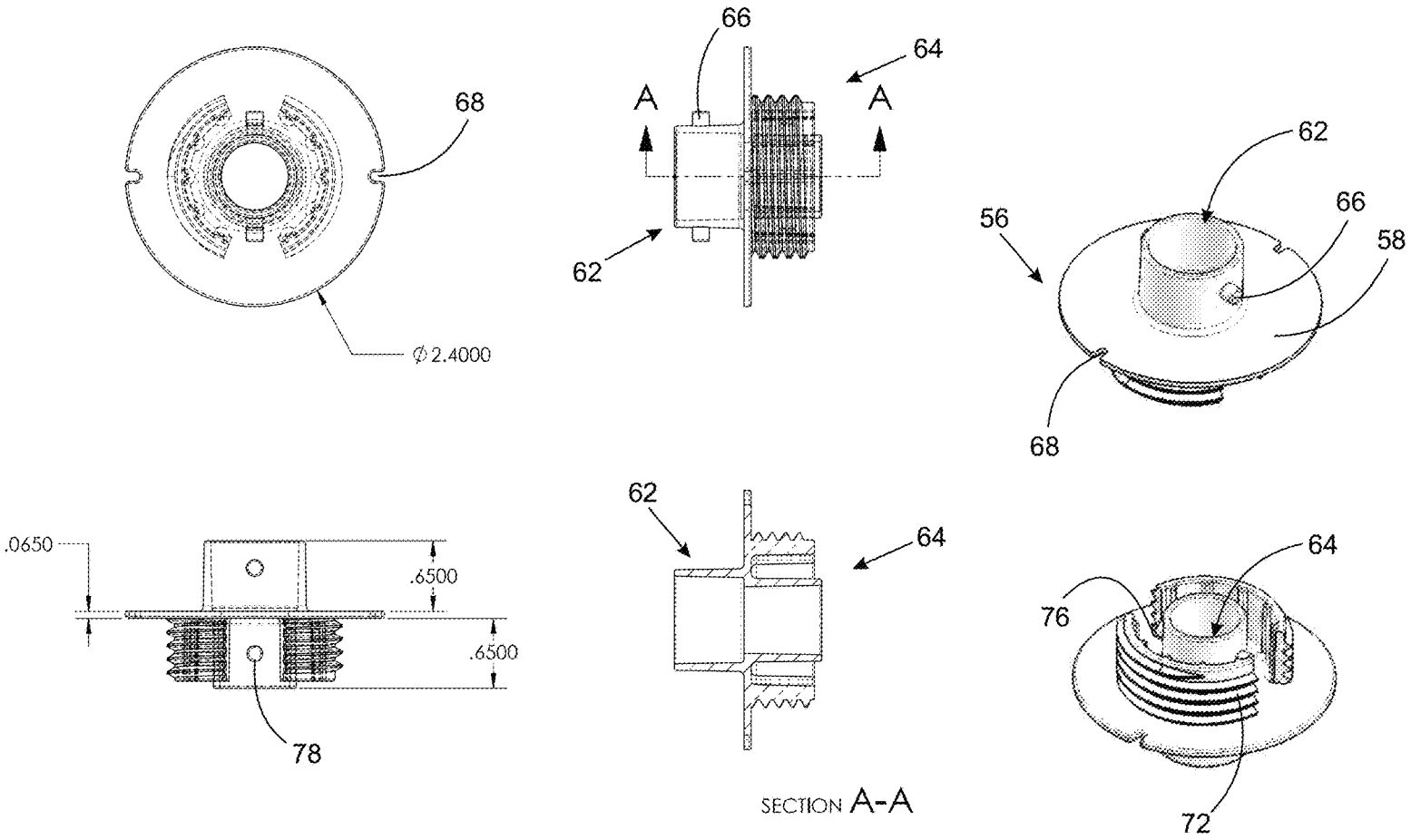
FIG. 8 illustrates various exemplary views of a vertical side wall nozzle which used on the vertical wall of the box spring.
Figure 9:
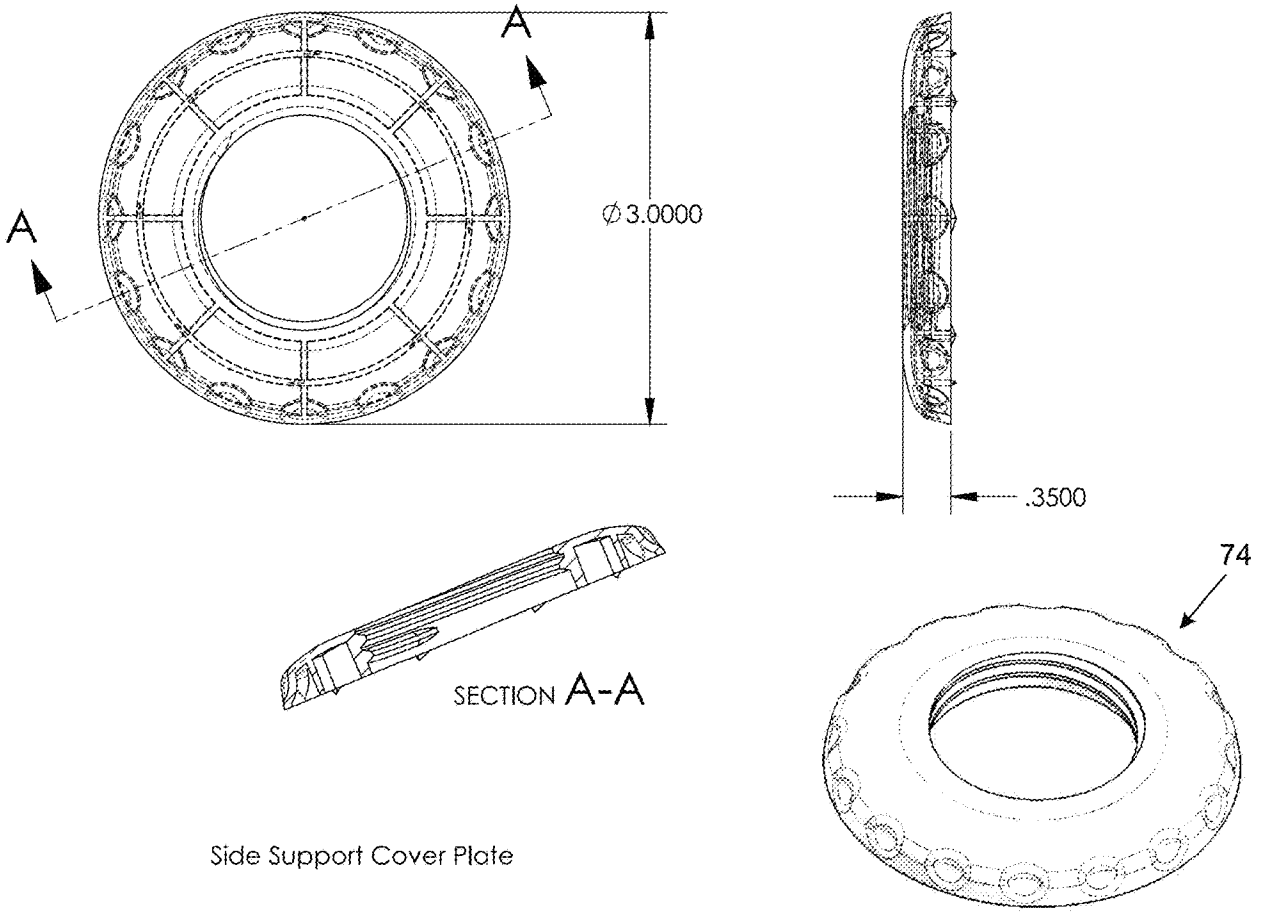
FIG. 9 illustrates various exemplary views of a nut used to secure the vertical side wall nozzle to a vertical wall of the box spring.

The side wall fittings 34 (FIG. 3) also include a side wall nozzle 56 (FIG. 8), which includes an internal nozzle portion 62 and an external nozzle portion 64. The external nozzle portion 64 extends outwardly from the flange portion 58, as shown in FIG. 8. The internal portion 62 may include one or more bayonet pins 66 for connection to a conduit 36 (FIG. 2). As best shown in FIG. 3, these bayonet pins 66 on the nozzle 56 (FIG. 8) cooperate with axially aligned slots "L" shaped slots 70 (FIG. 3) on the internal conduit 36. The internal and external portions 64 (FIG. 8) and 62 of the nozzle 56 may have different diameters.

Figure 5:
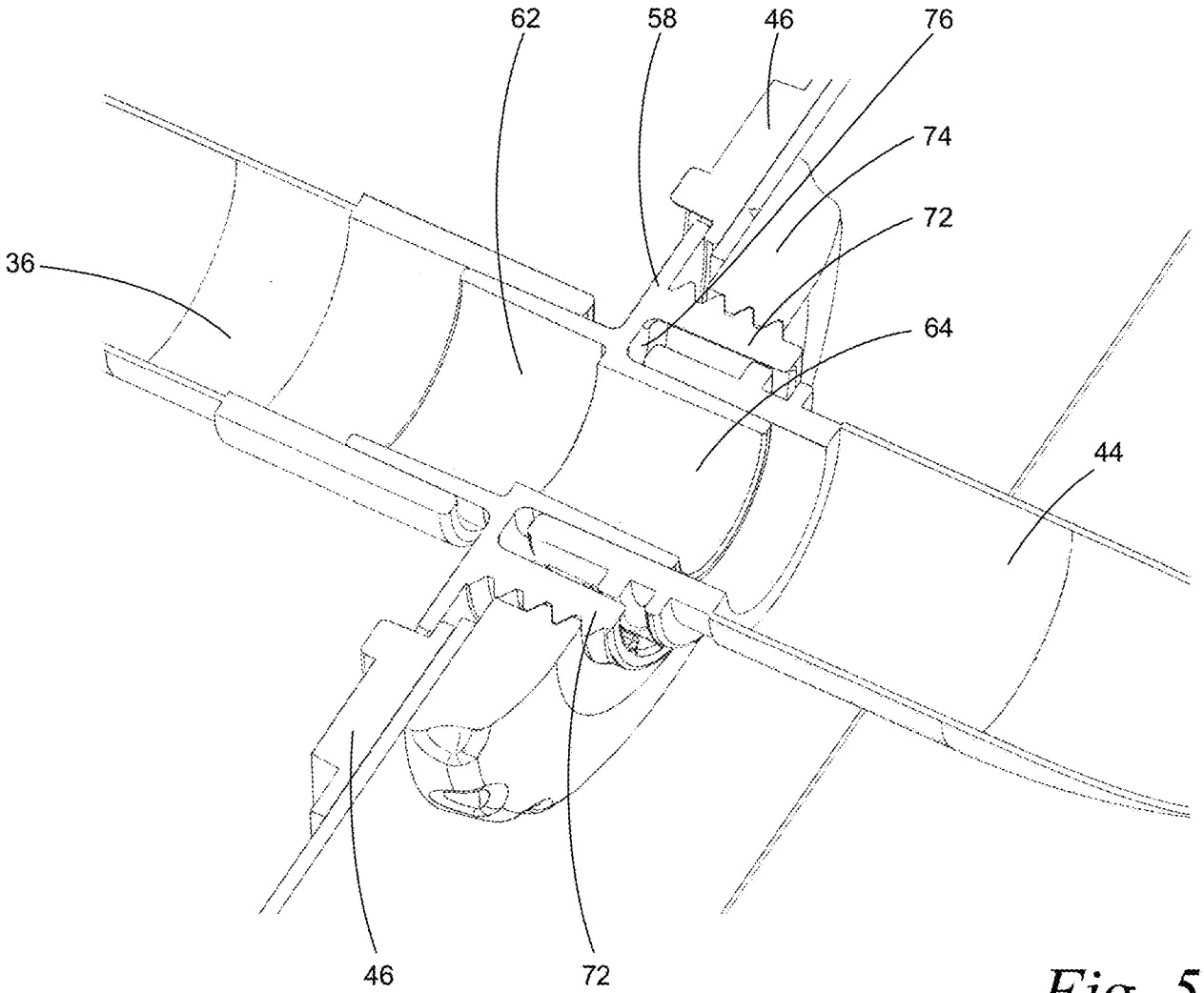
FIG. 5 is similar to FIG. 4 but illustrates the fittings, stiffener plate, and the internal and external conduits in section.
Figure 6:
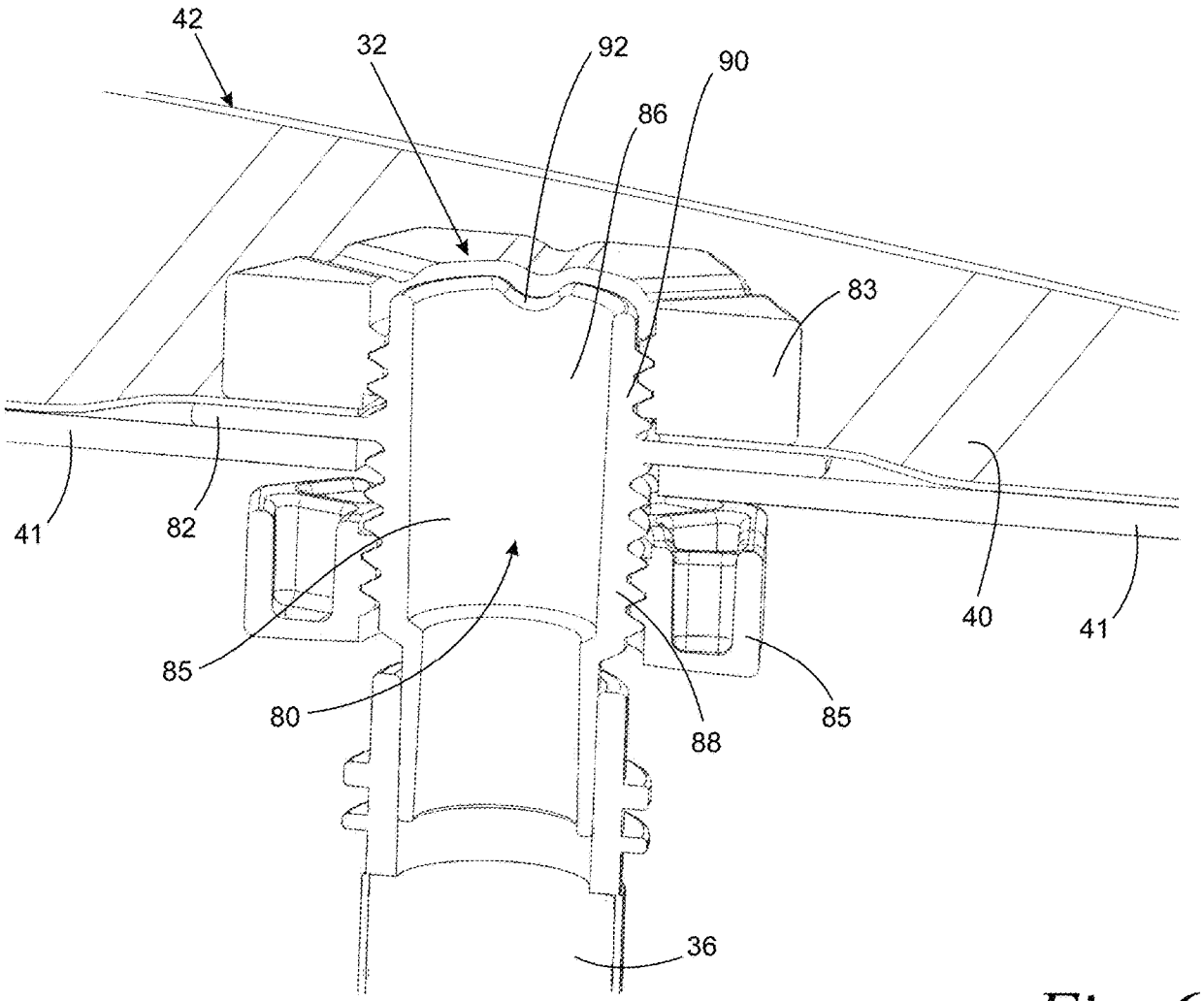
FIG. 6 is an isometric view of the fittings connected to a top surface of the box spring and into the inflatable volume, shown in section, with a portion of an internal conduit connected to an interior portion of the fitting.

The external portion of the vertical wall nozzle 56 includes two or more arcuately spaced apart sidewalls, generally identified with the reference numeral 72 (FIG. 8). These sidewalls portions 72 are threaded and are spaced away from the outside diameter of the external nozzle portion 64, forming an annular gap 76 for receiving an external conduit 44, as best shown in FIG. 5. The threaded portions 72 on the nozzle 56 are for receiving another component of the sidewall fittings 34 (FIG. 3), namely, a threaded compression ring 74 (FIG. 9) for securing the nozzle 56 (FIG. 8) to the stiffener plate 46 (FIG. 10). As best shown in FIG. 5, the axial thickness of the compression ring 74 may be optionally less than the axial length of the external nozzle portion 64.

Figure 4:
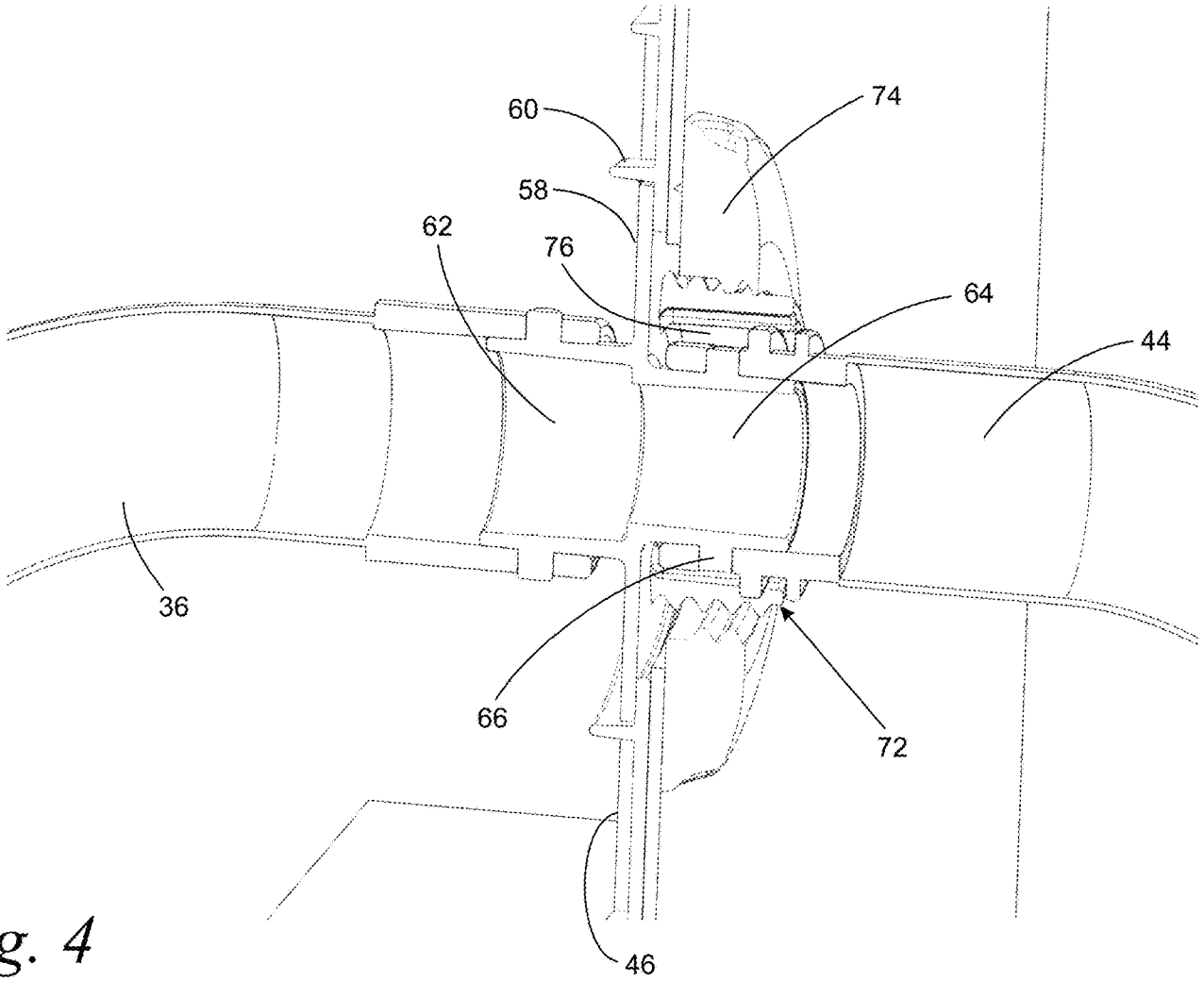
FIG. 4 is an isometric view shown in section of the fittings and the stiffener plate connected to a vertical wall of a box spring, also shown with an interior conduit connected to an interior portion of the fitting and an external conduit connected to an external portion of the fitting.

As shown in FIG. 4, the external nozzle portion 64 of the nozzle 56 may be formed with one or more bayonet pins 66 These bayonet pins 66 cooperate with bayonet slots (not shown) formed on a free end of the external conduit 44. As shown best in FIG. 4, the external conduit 44 is secured to the external nozzle portion 64 by way of the bayonet connection described above.

Once the stabilizer plate 46 is secured to the box spring 20, as discussed above, the flange portion 58 of the vertical sidewall nozzle 56 is inserted in the aperture 54 in the stiffener plate 46 and rotated until the radial tabs 47 in the stiffener plate 46 are received in the notches 68 (FIG. 8) on the flange 58. The compression ring 74 (FIG. 9) is then tightened around the threaded portion 72 (FIG. 8) of the external nozzle portion 64, thereby securing the vertical fitting 56 (FIG. 8) to the stiffener plate 50 (FIG. 10), as shown in FIGS. 4 and 5.

FIGS. 6, 7, 11 and 12 illustrate the top fittings 32 (FIG. 3) connected to a bottom layer 40 of the inflatable volume. The top fittings 32 (FIG. 3) include a nozzle 80 (FIG. 12), an external compression ring 83 (FIG. 6) and an optional internal compression ring 83. The nozzle 80 (FIG. 12) includes a flange portion 82 and an internal nozzle portion 85 and an external nozzle portion 86. As shown, the flange portions 82 are disposed on top of a layer 41 of the foundation and under a bottom layer 40 of the inflatable volume 42. These nozzle portions 85 and 86 are for receiving the internal compression ring 85 (FIG. 6) and external compression ring 83, respectively. These compression rings 83 and 87 compress a bottom layer 40 of the inflatable volume 42 and top of a layer 41 of the foundation with respect to the flange portion 82.

A free end of the internal nozzle portion 84 (FIG. 12) may include one or more bayonet pins 90. These bayonet pins 90 cooperate with a bayonet slot 92 (FIG. 3) on the end of the internal conduit 36.

The external compression ring 83 (FIG. 3) compresses a bottom layer 40 of the inflatable volume 42 and any box spring padding 41 against the flange portion 82 of the nozzle 80. An optional internal compression ring 84, which may be similar to the compression ring 83, compresses the box spring padding 41 which forms part of a top surface of the box spring 20 against the underside of the flange portion 82.

Figure 7:
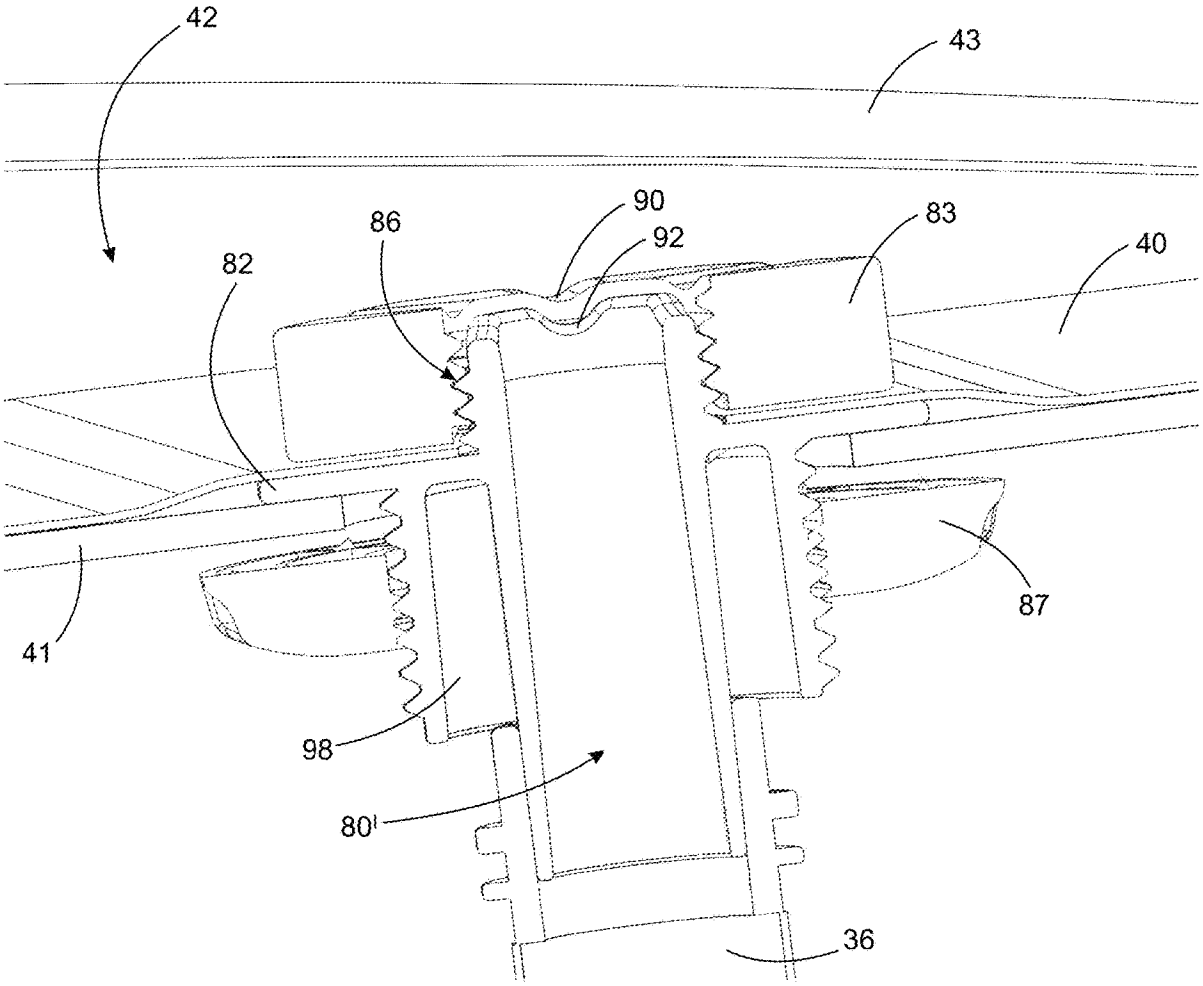
FIG. 7 is similar to FIG. 6 but illustrating an alternate embodiment of the nozzle attached to the top surface of the box spring and into the inflatable volume.
Figure 11:
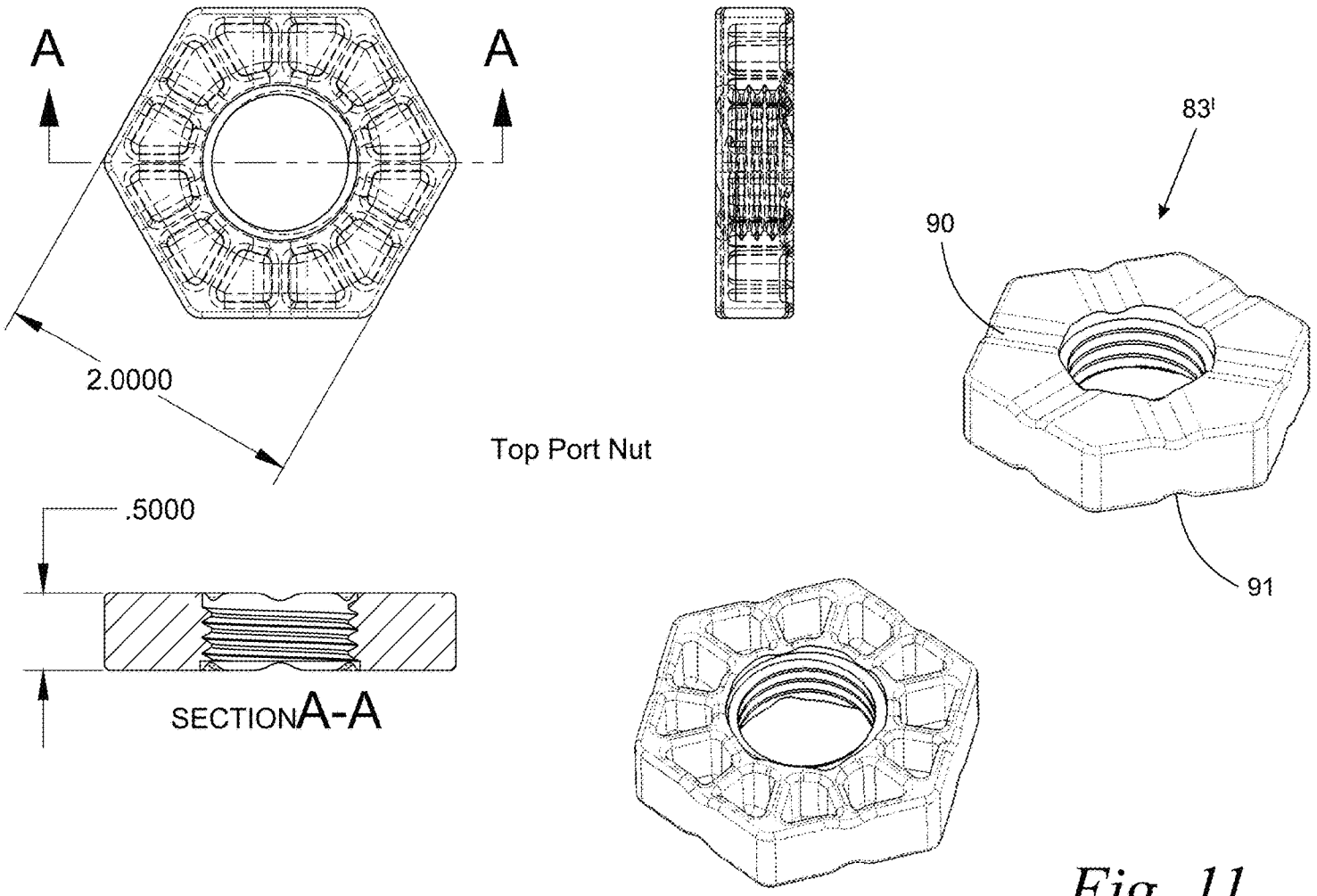
FIG. 11 illustrates various exemplary views of an alternative embodiment of a compression nut used to secure a vertical nozzle to a top surface of the box spring.

Referring to FIG. 11, the external compression ring 83 may be provided with a plurality of radial notches 90. These notches 90 cooperate with one or more radially aligned notches 92 (FIG. 12) are formed on a free end of the external nozzle portion 86. These notches 90 and 92 allow air into the inflatable volume 42 initially when the weight of the mattress (not shown) pushes down on the top surface of the external nozzle portion 86. As best shown in FIG. 7, the notches 90 on the compression ring 83 are slightly higher than the notches 92 on the nozzle portion 86 (FIG. 12). This configuration allows air to escape into the inflatable volume 42 when an external air pump (not shown) is first turned on when the mattress is sitting on top of the compression ring 83 and initially blocking normal air flow from the nozzle 86.

FIG. 11 illustrates an alternate embodiment of the compression ring 83 and is generally identified with the reference numeral 83'. The alternate compression ring 83' is virtually the same as the compression ring 83 but further includes notches 91 on the bottom of the compression ring. These notches 91 (FIG. 11) allow air received by way of the notches 92 (FIG. 12) in the nozzle 80 and the vertical gap 93 to escape through the bottom of the external compression ring 83 (FIG. 11), when the mattress (not shown) is sitting on top of the upper layer 41 of the inflatable volume 42 which, in turn, will press down onto the top of the compression ring 83.

An alternate embodiment of the nozzle 80 is illustrated in FIG. 7 and is identified with the reference numeral 80'. This nozzle 80' is similar to the nozzle 80 (FIG. 12) but also includes an annular chamber 98. The annular chamber 98 expands the diameter of the nozzle portion 85 (FIG. 12) to the diameter of the compression ring 74 (FIG. 9) to reduce the number of parts.

Figure 1A:
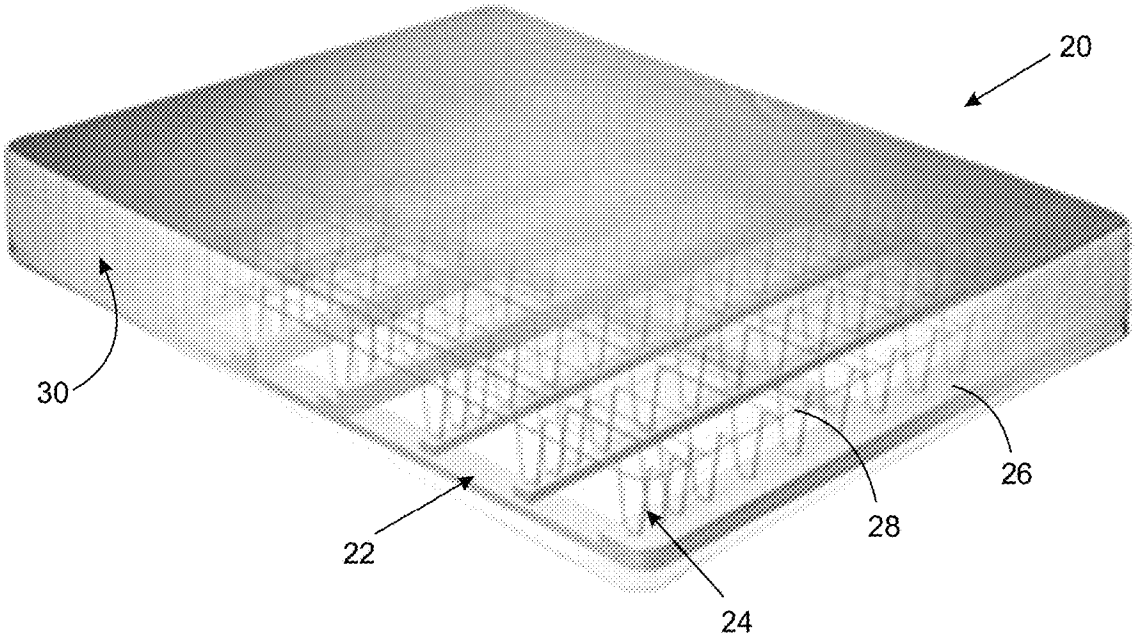
FIG. 1A is an isometric view of a conventional box spring shown with the cover partially removed.
Figure 1B:
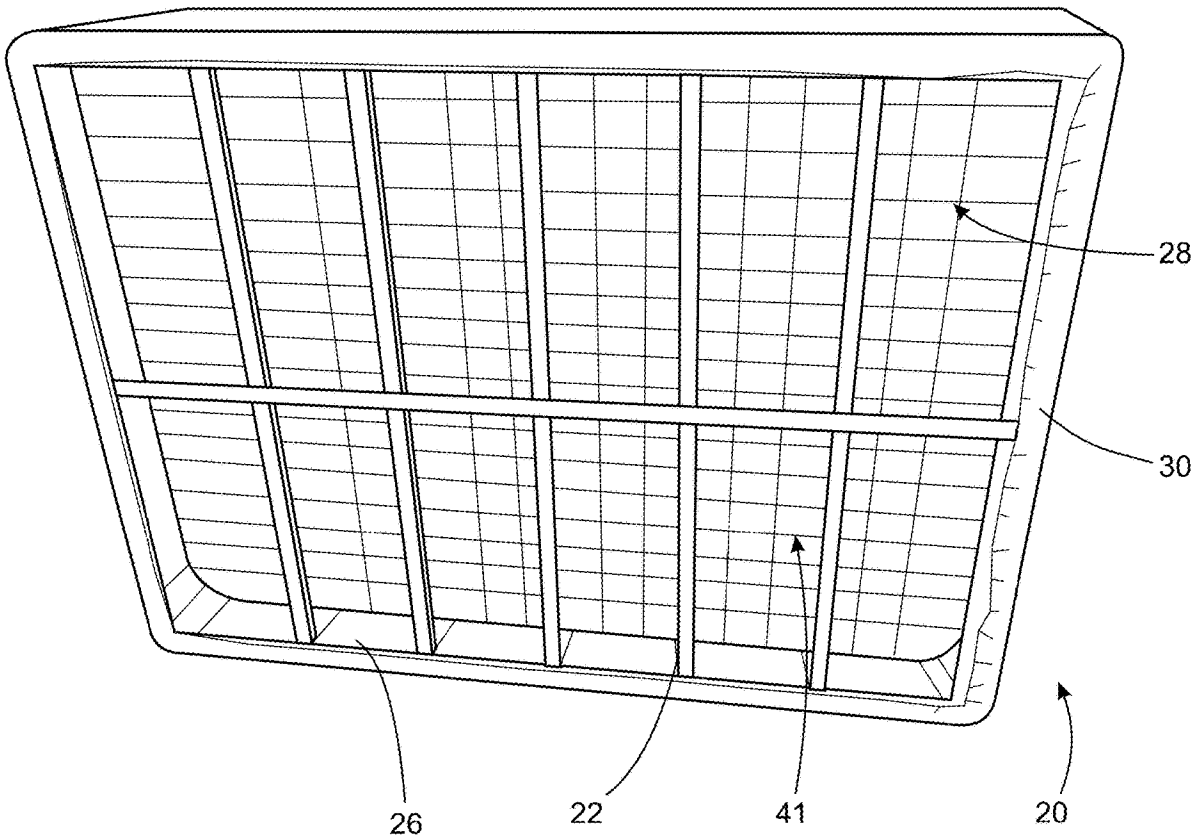
FIG. 1B is an isometric view of a bottom view of a conventional box spring.

In order to assemble the fittings 32 and 34 (FIG. 3) to a box spring 20, as illustrated in FIGS. 1 and 2, the vertical side wall fittings 34 (FIG. 3) may be first assembled to a sidewall of the box spring 20. Specifically, the curled tabs 48 (FIG. 10) on the stiffener plate 52 are hooked to a traverse rod 28 (FIG. 3) to secure one end 50 (FIG. 10) of the stiffener plate 46 to the box spring 20. The opposing end 52 of the stiffener plate 46 is attached to the wood frame 22 (FIG. 1A), for example, by way of one or fasteners, such as staples.

The vertical wall nozzle 56 (FIG. 8) is disposed within the aperture 54 (FIG. 10) in the stiffener plate 46 and captured within the annular wall 60 (FIG. 4). The nozzle 56 is disposed within the aperture 54 so that the threaded sidewall portions 72 (FIG. 4) extend outwardly and the radial tabs 47 (FIG. 10) on the stiffener plate 46 are received in the notches 68 (FIG. 8) formed in a flange portion 58 of the vertical wall nozzle 56. The threaded ring 74 (FIG. 9) is then screwed onto threaded sidewall portions 72 (FIG. 8) to secure the nozzle vertical side wall nozzle 56 to the stiffener plate 46 (FIG. 10).

The top fittings 32 (FIG. 2) include a nozzle 80 (FIG. 12), an internal compression ring 84 (FIG. 2) and an internal compression ring 83. The flange portion 82 (FIG. 12) of the nozzle 80 is disposed under the bottom layer 40 (FIG. 2) of the inflatable volume while its external nozzle portion 86 extends into the inflatable volume 42, formed by the bottom layer 40 an additional layer 43 forming the inflatable volume 42. An internal compression ring 84 is threaded onto the internal nozzle portion 85 of the nozzle 80. Similarly, the external compression ring 83 is threaded onto the external nozzle portion 86. The internal compression ring 84 and the external compression ring 83 compress the bottom layer 40 of the inflatable volume and any box spring padding 41 relative to the flange portion 82 of the nozzle 80.

The conduit 36 is attached to the upper nozzle 80 and the vertical wall nozzle 56. More particularly, one end of the conduit 36 is connected to the vertical wall nozzle portion 62 (FIG. 2) so that the bayonet pins 66 are received in the "L" shaped slots 70 (FIG. 3). The conduit 36 is then rotated until the bayonet pins 66 are in a locked position with respect to the slots 70.

Next, the other end of the conduit 36 is connected to the internal nozzle portion 85 (FIG. 2) of the nozzle 80. In order to line up the bayonet pins 90 (FIG. 12) on the nozzle 80 with the slots 92 (FIG. 3) on the end of the conduit 36, the nozzle 80 is rotated so that the bayonet pins 90 (FIG. 12) are received in the slots 92 (FIG. 3) and rotated to a locked position.

FIGS. 29 and 30 illustrate another embodiment of the invention. In this embodiment, the interior nozzle portion 85" of the top nozzle 80" is formed with an increased diameter portion 140. This allows a compression ring 74 (FIG. 9) to be used for the top nozzle 80" in order to eliminate a second compression ring 84 (FIG. 2)

Referring to FIG. 13, an alternate embodiment of the stiffener plate 46 illustrated in FIG. 10, involves machining the stiffener plate 46". The stiffener plate 46' includes a through hole 54' and an annular wall 60'. One or more radial tabs 47' are formed between a pair of outwardly extending knobs 100. In this embodiment, the stiffener plate 46' is only fastened to the box spring 20 on one end 101, for example by staples.

FIGS. 14 and 15 illustrate an alternate embodiment of the side wall nozzle fittings illustrated in FIG. 8. The only difference between these embodiments relates to the external nozzle portion 64 of vertical wall nozzle 56. In particular, as best shown in FIGS. 4 and 8, the external nozzle portion 64 of the nozzle 56 is formed with an external male coupling, namely bayonet pins 78. In the alternate embodiment illustrated best in FIG. 16, an external nozzle portion 64' of a vertical wall nozzle 56' is formed with a female connection, namely bayonet slots 103.

FIGS. 16-28 illustrate another alternate embodiment of the fittings illustrated in FIGS. 2-12. This embodiment includes a vertical wall fittings 105 (FIG. 23) which include a vertical wall support plate 104 (FIG. 25), a side support cover plate 106 (FIG. 24) and top fittings 107 (FIG. 20) which include a top cover plate 108 (FIG. 27) and a top port 110 (FIG. 28). These components are configured to ratcheted together and do not require compression rings.

Figure 18:
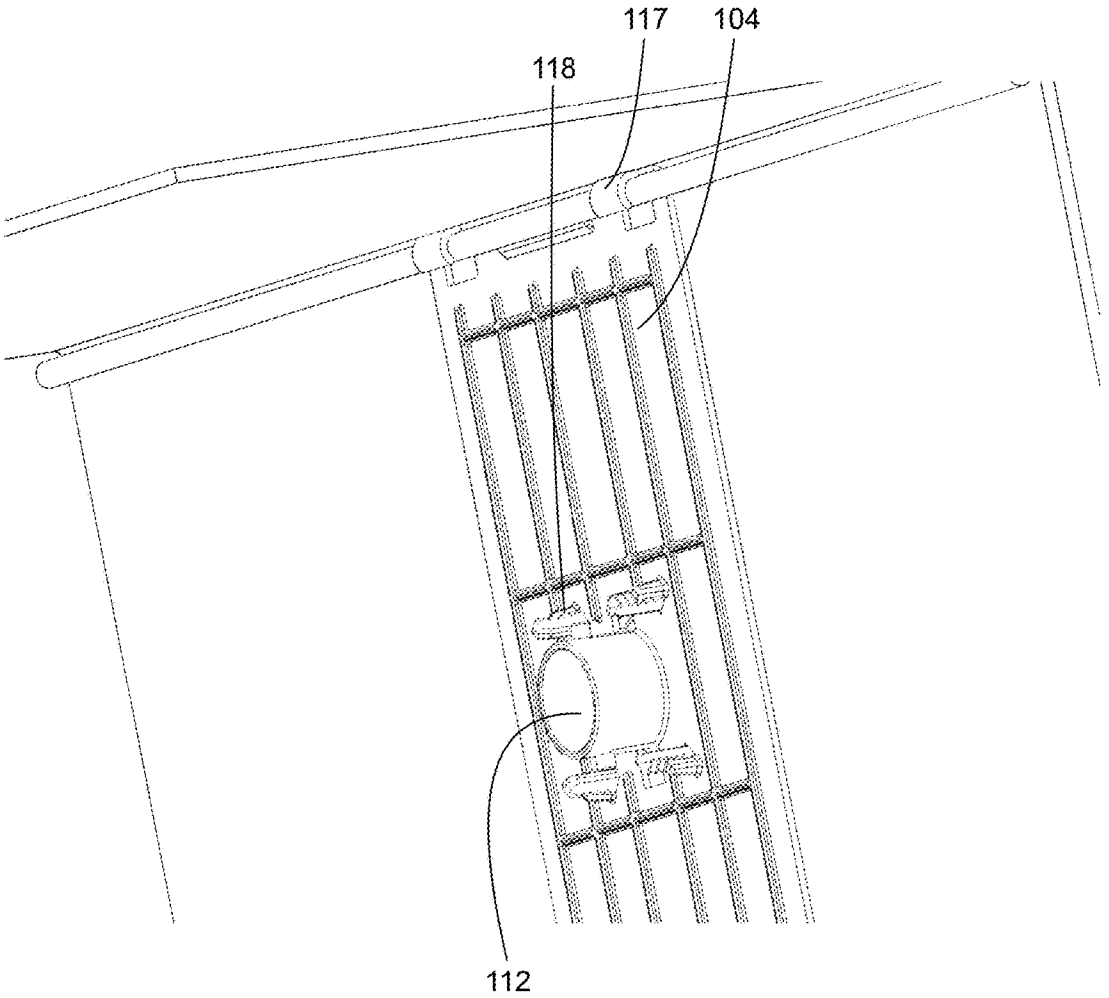
Figure 21:
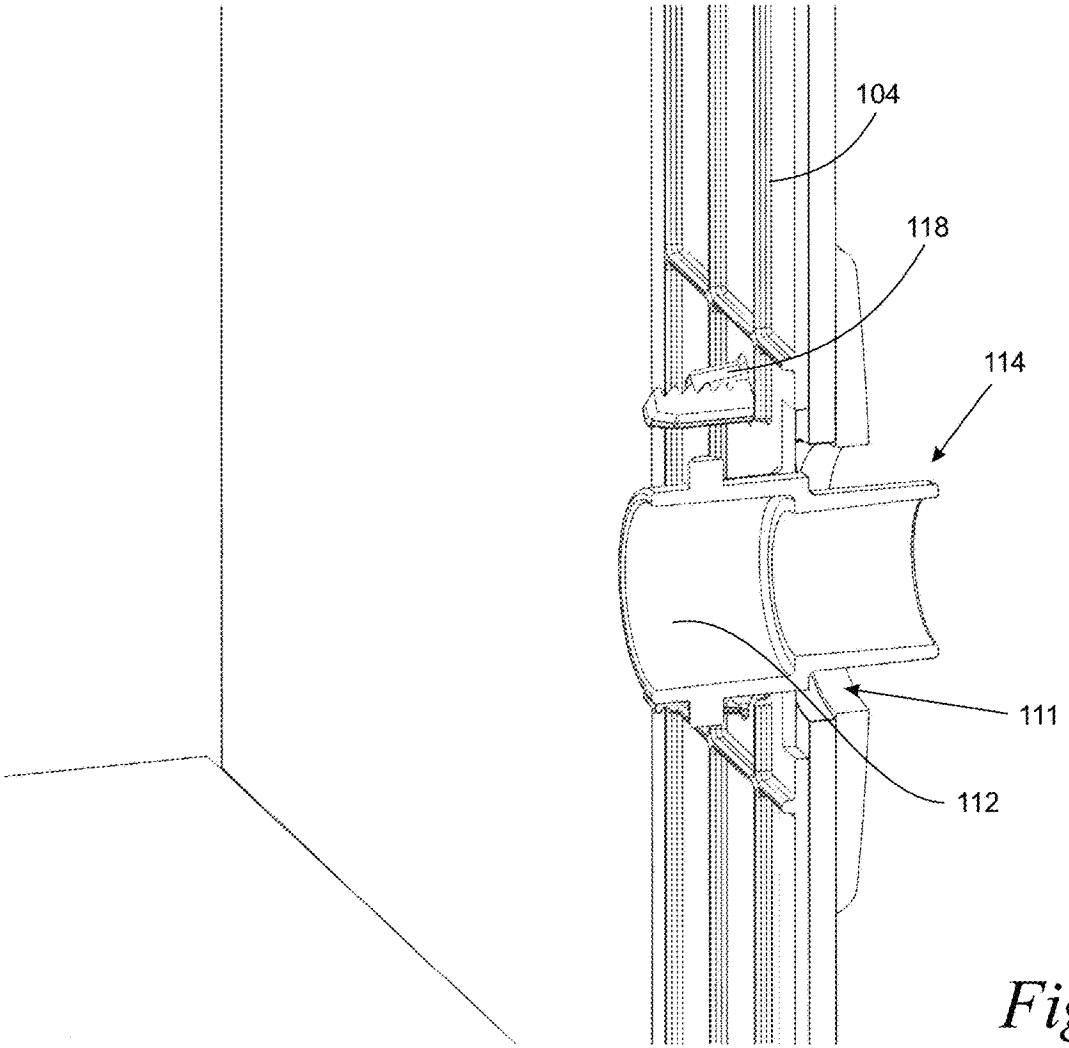
Figure 22:
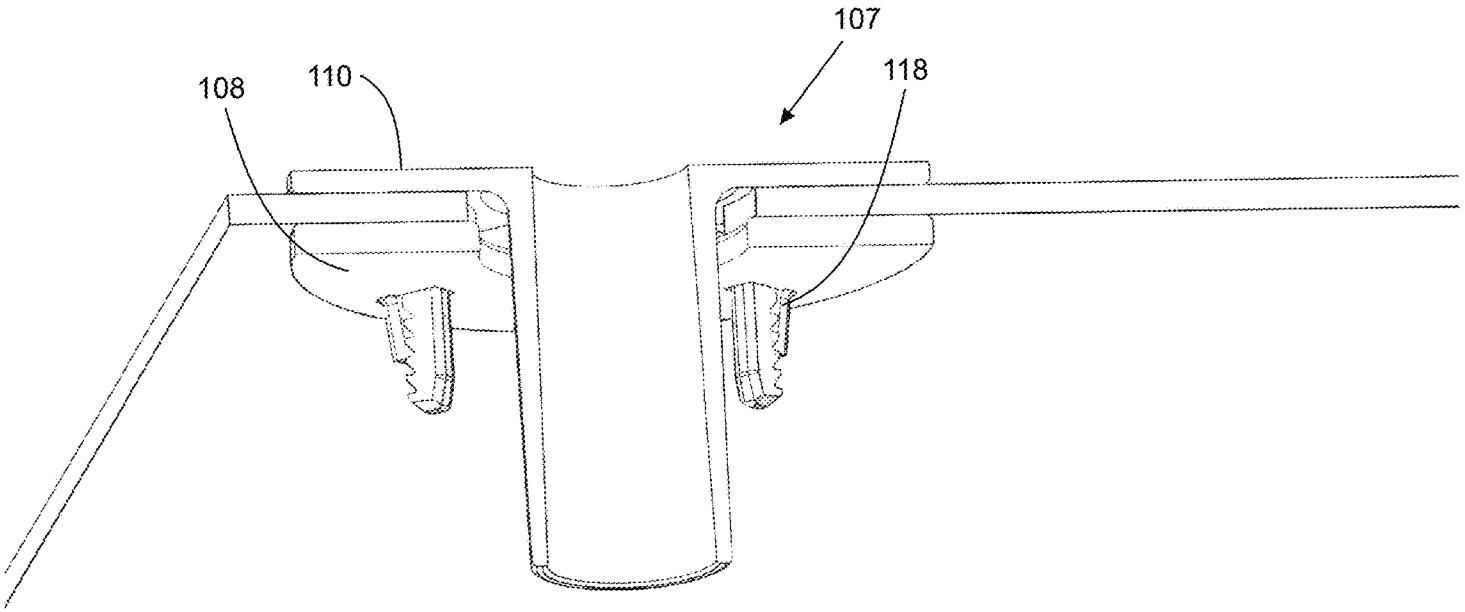
Figure 23:
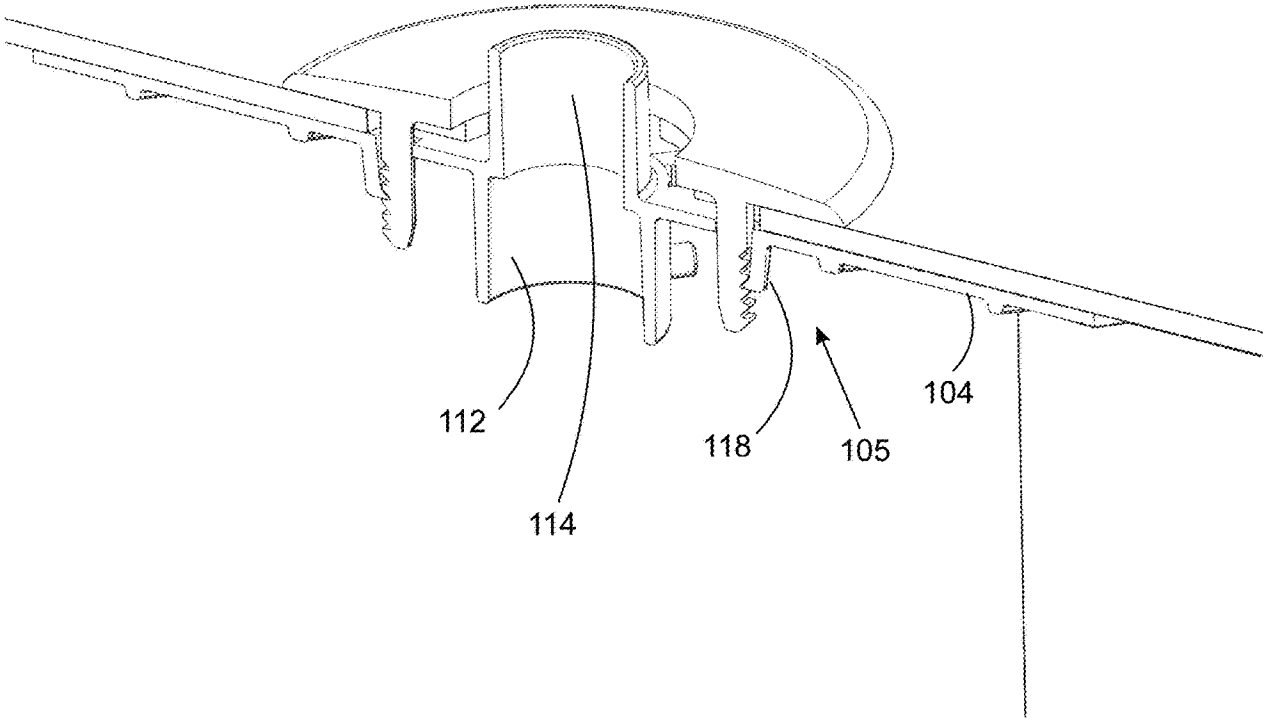
Figure 24:
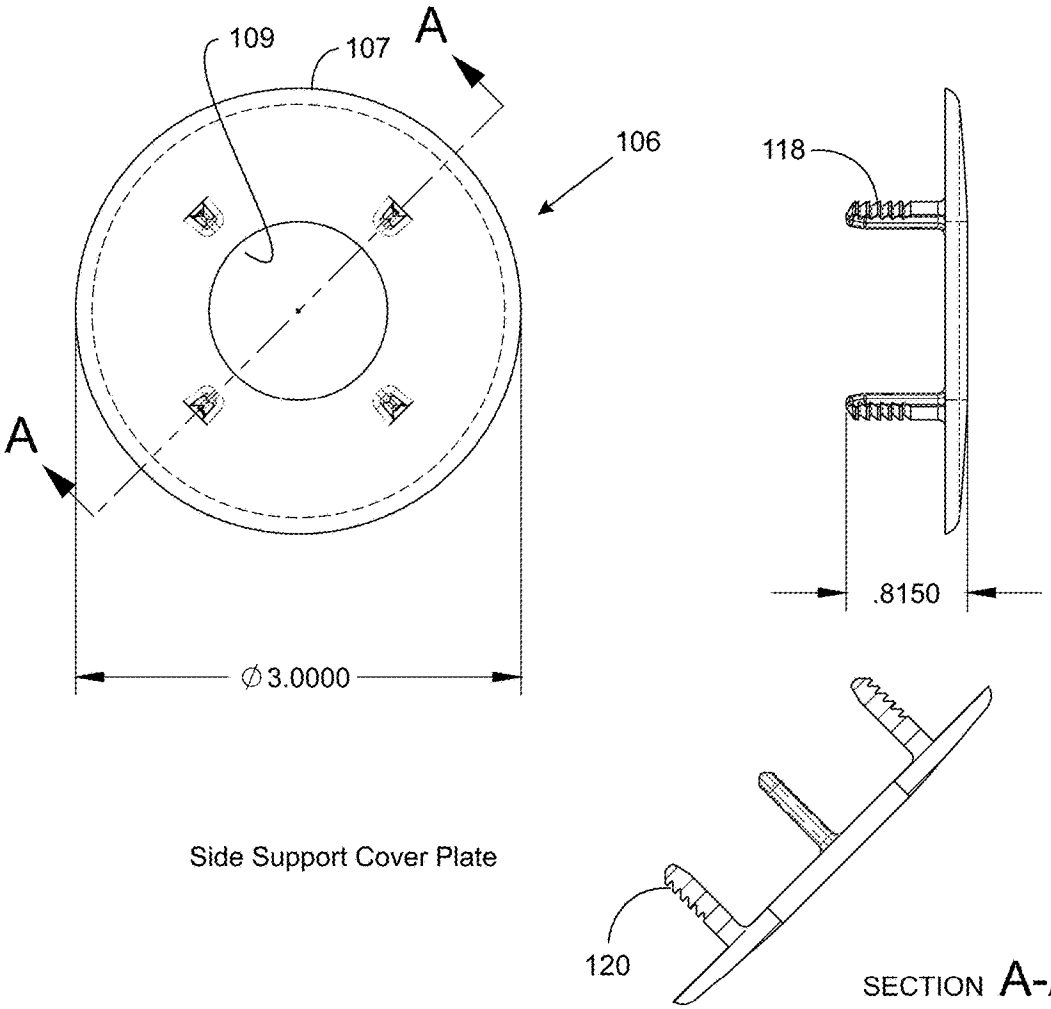
Figure 25:
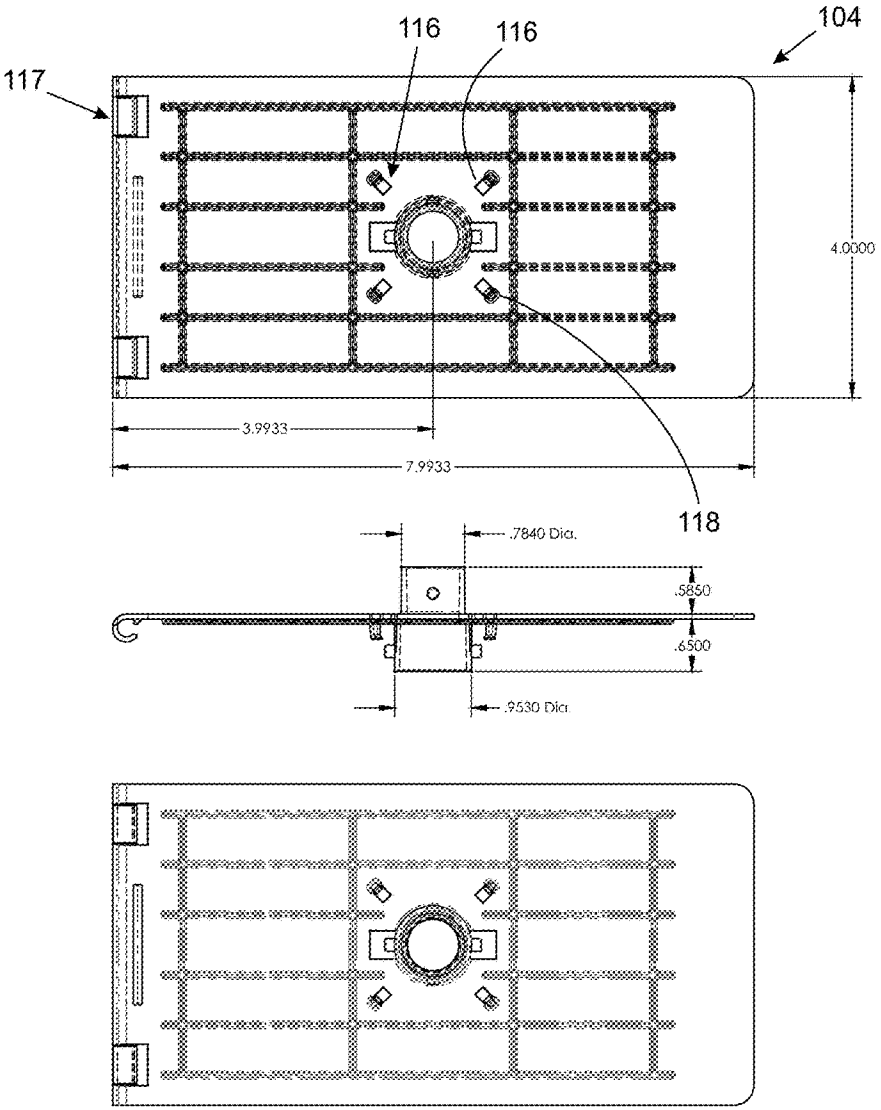
Figure 26:
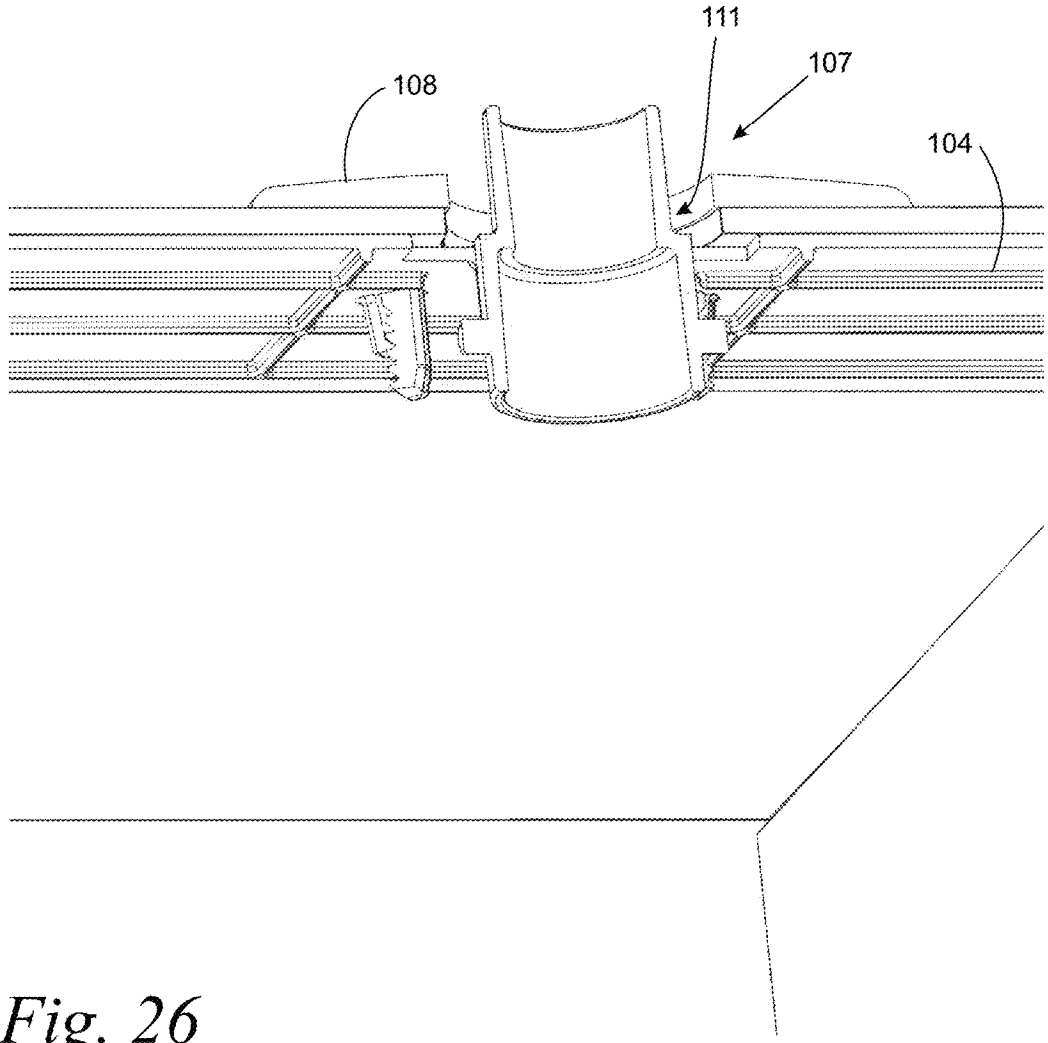

Referring first to the vertical wall fittings 105. FIGS. 21 and 23 illustrate a vertical wall stiffener plate 104. The vertical sidewall stiffener plate 104 includes an inner nozzle portion 112 (FIG. 21) and an external nozzle portion 114. The vertical wall stiffener plate 104 includes one or more curled tabs 117 (FIG. 25) for hooking one end of the stiffener plate 104 onto a traverse rod 28 (FIG. 1A) in the box spring 20, as shown in FIG. 18. The other end of the stiffener plate 104 (FIG. 25) may be formed with a reduced thickness and can be stapled to cross members 26 (FIG. 1A) of the wood frame 22. The stiffener plate 104 also includes four through holes 116 (FIG. 25) that may be symmetrically located relative to the nozzles 112 and 114. A ratchet 118 (FIG. 24) is disposed adjacent each through hole 116.

Figure 19:
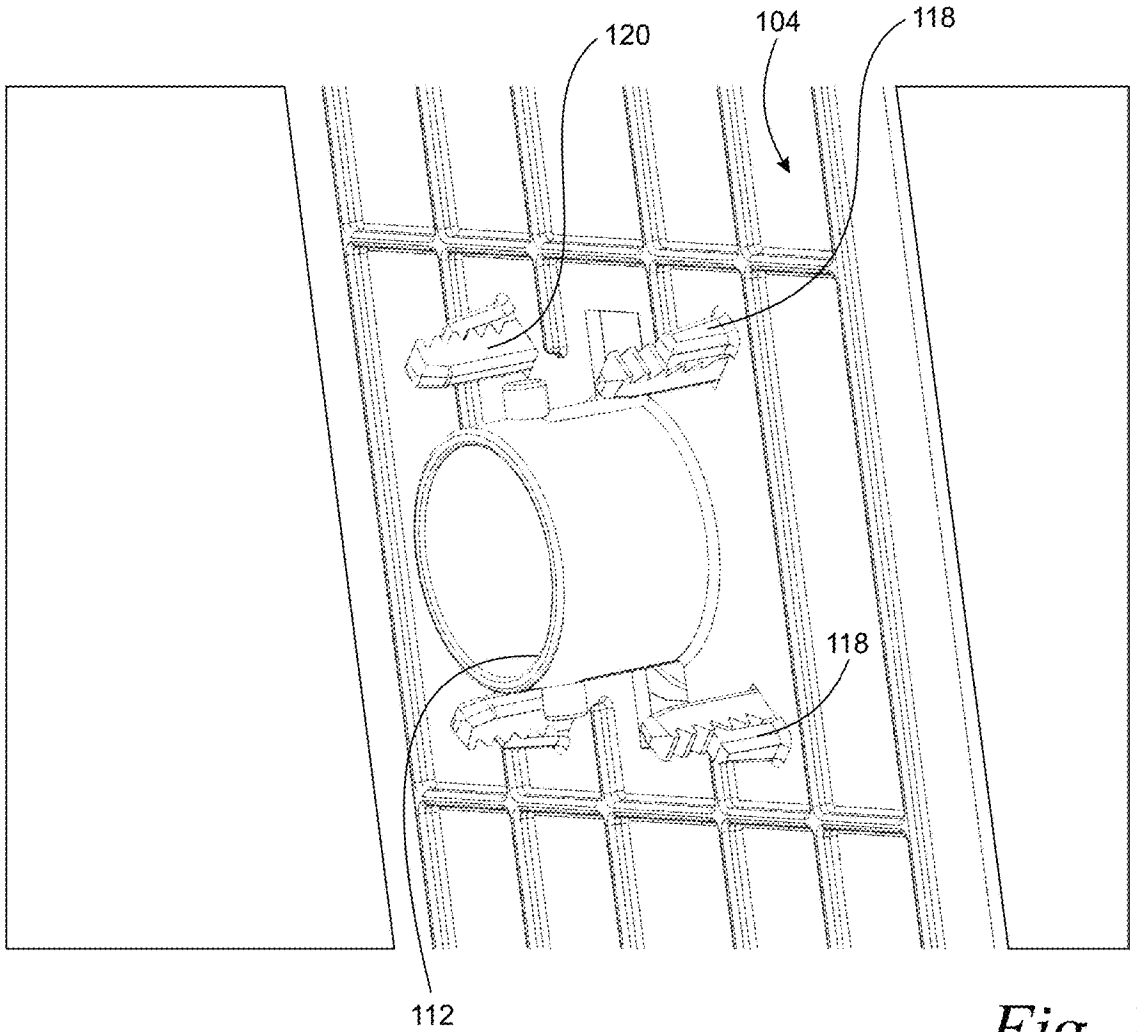
Figure 20:
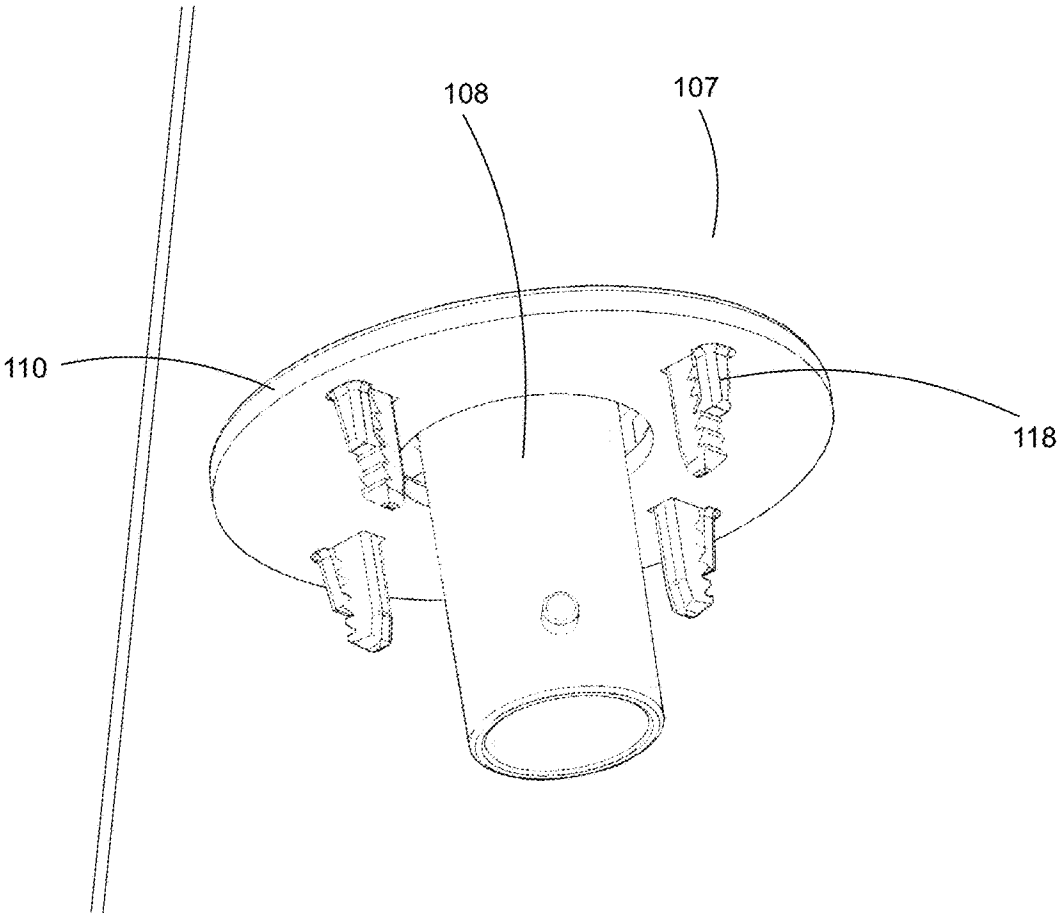

The side support plate 106 (FIG. 24) is formed with a circular flange portion 107 and inwardly directed toothed studs 120 that are aligned with the through holes 116 (FIG. 25) in the stiffener plate 104. The toothed studs 120 are inserted into the through holes 116 in the stiffener plate 104, as best shown in FIG. 19. The toothed studs 120 (FIG. 24) cooperate with the ratchet 118 (FIG. 19) to allow the components to be ratcheted together.

As best shown in FIG. 21, the stiffener plate 104 includes an internal nozzle portion 112 and an external nozzle portion 114. The external nozzle portion 114 is formed with a smaller diameter than a through hole 109 (FIG. 24) in a side support plate 106 thus forming an annular gap 111 (FIG. 26) therebetween for receiving a nozzle of an external air source (not shown).

Figure 27:
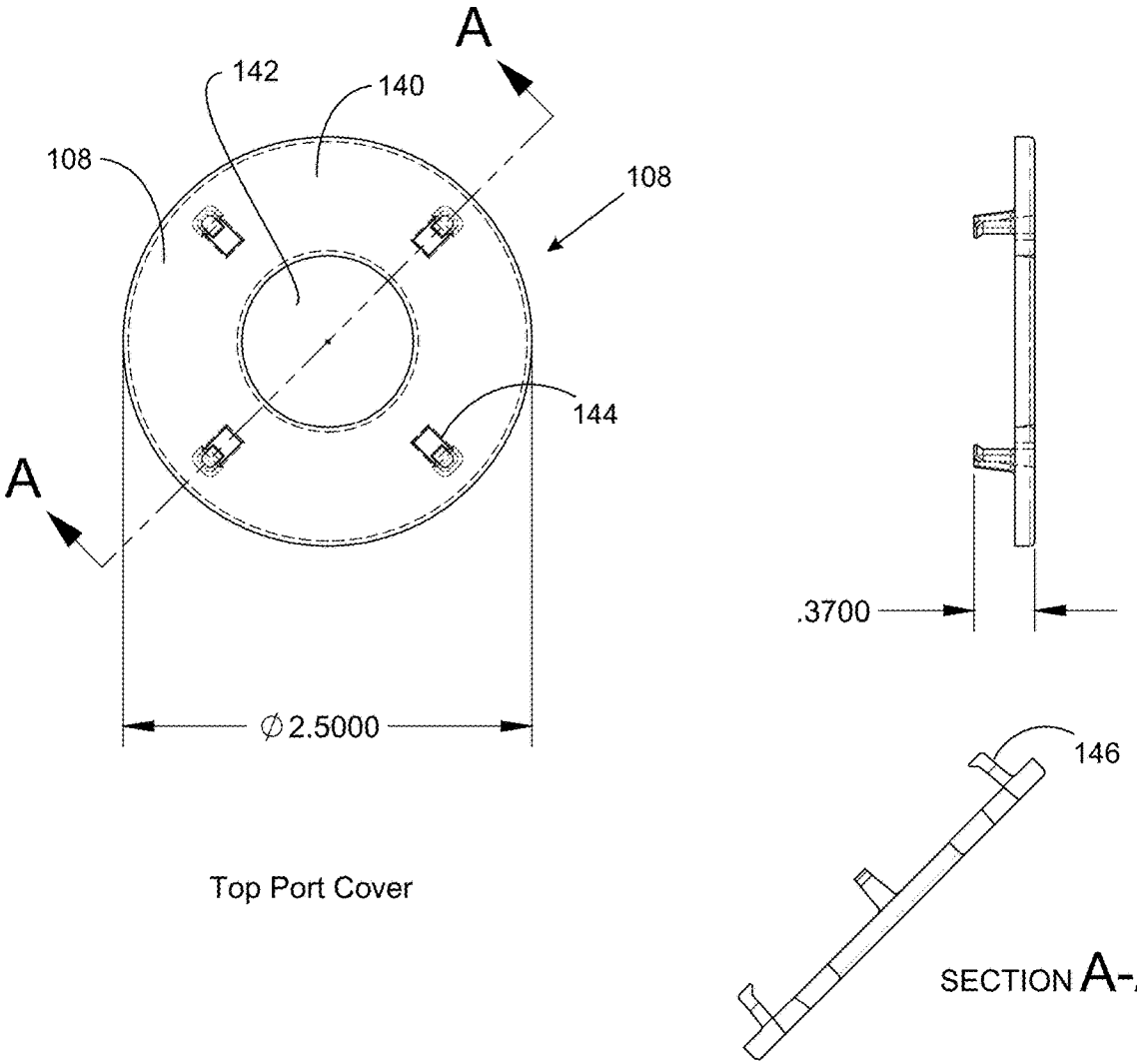

The top fittings 107 (FIG. 20) include a top port 110 (FIG. 28) and a top port cover 108 (FIG. 27). The top port 110 includes a circular flange portion 130; an inwardly directed nozzle portion 132 and a plurality inwardly directed toothed studs 134. One or more bayonet pins 136 may be provided on the nozzle portion 132 for connection to an external conduit discussed above. In this embodiment, the top port cover 110 is disposed on top of a top cover 141 (FIG. 16) of the foundation.

The top cover plate 108 is formed with a circular flange portion 140 and a through hole 142 for receiving the nozzle portion 132 (FIG. 28) of the top port 110. In this embodiment, the top cover 108 is disposed under the top cover 141 (FIG. 20) of the foundation 20 (FIG. 1A). The top cover 108 includes a plurality of through holes 144 configured to be aligned with the extending toothed studs 134 (FIG. 28) on the top port 110 to enable the parts to be ratcheted together.

FIG. 31 illustrates another embodiment of the invention. This embodiment includes a top port 150 having a head portion 152 and a nozzle portion 154. The nozzle portion 152 is threaded and may include one or more bayonet pins 156. The top port 150 includes a hollow 158 head portion. The head portion 158 includes one or more air escape holes 160 that are in fluid communication with the hollow nozzle portion 154. The top port 150 is mounted on top of a bottom layer of an inflatable volume, as discussed above.

Figure 39:
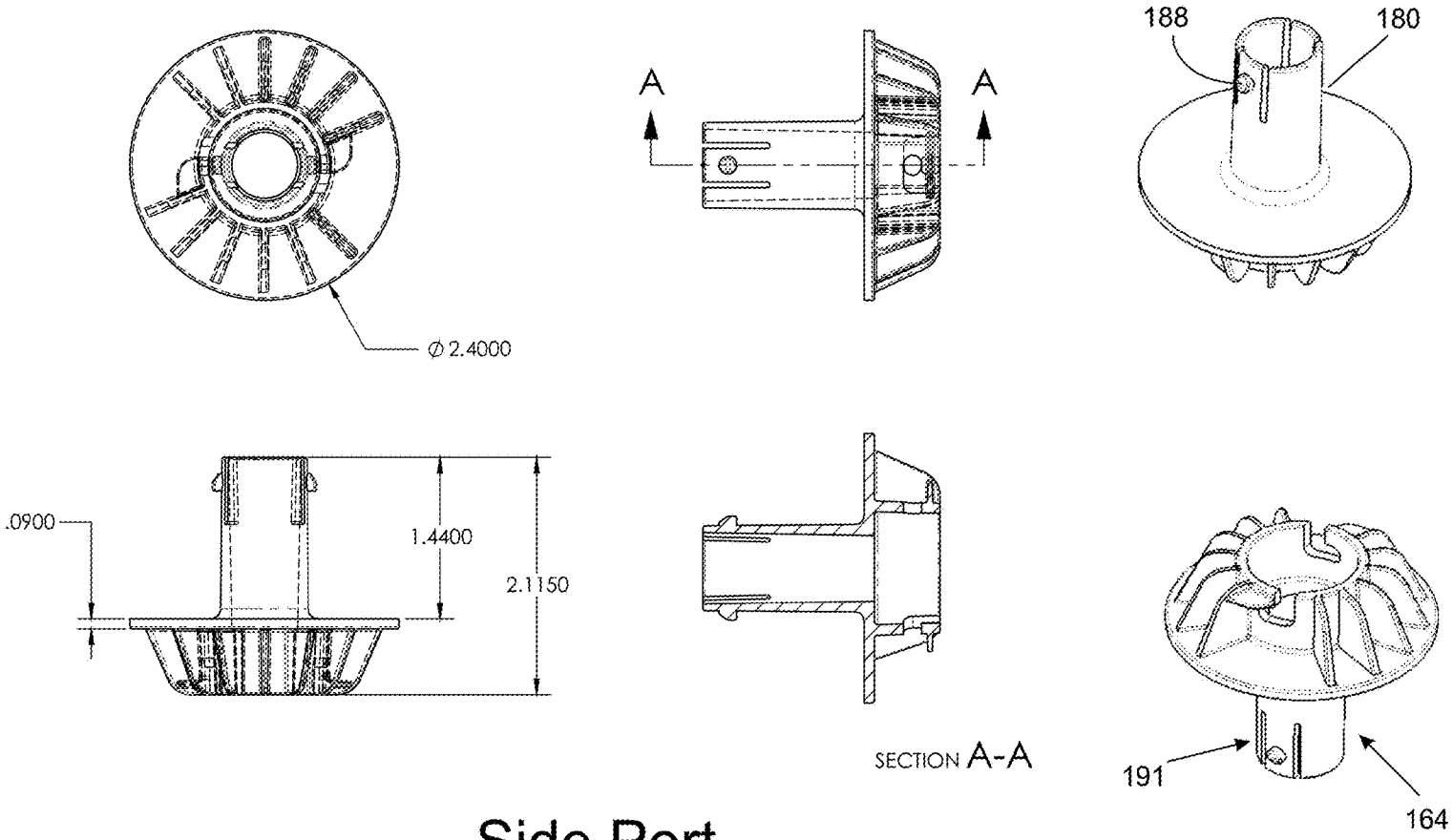
Figure 40:
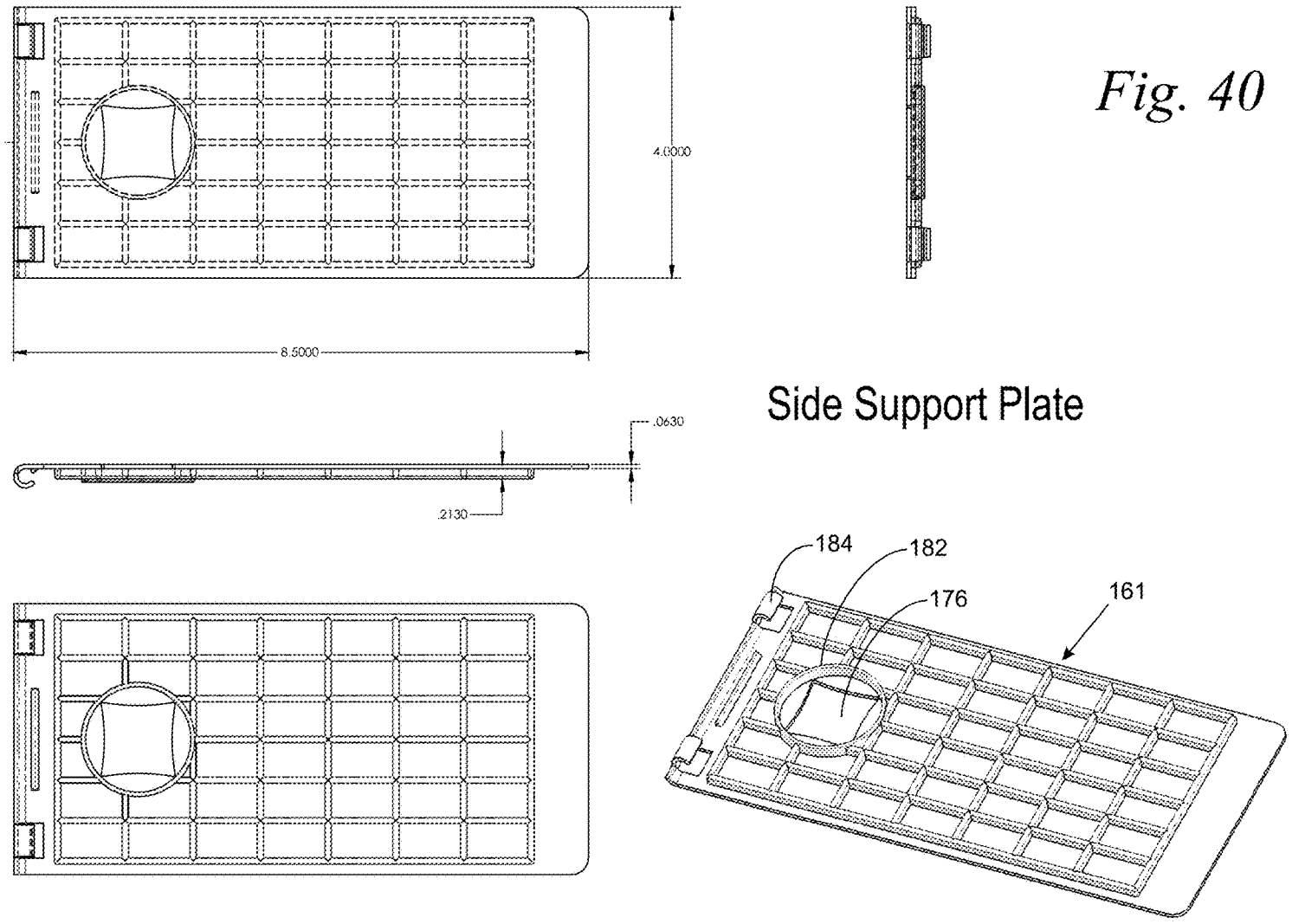
Figure 41:
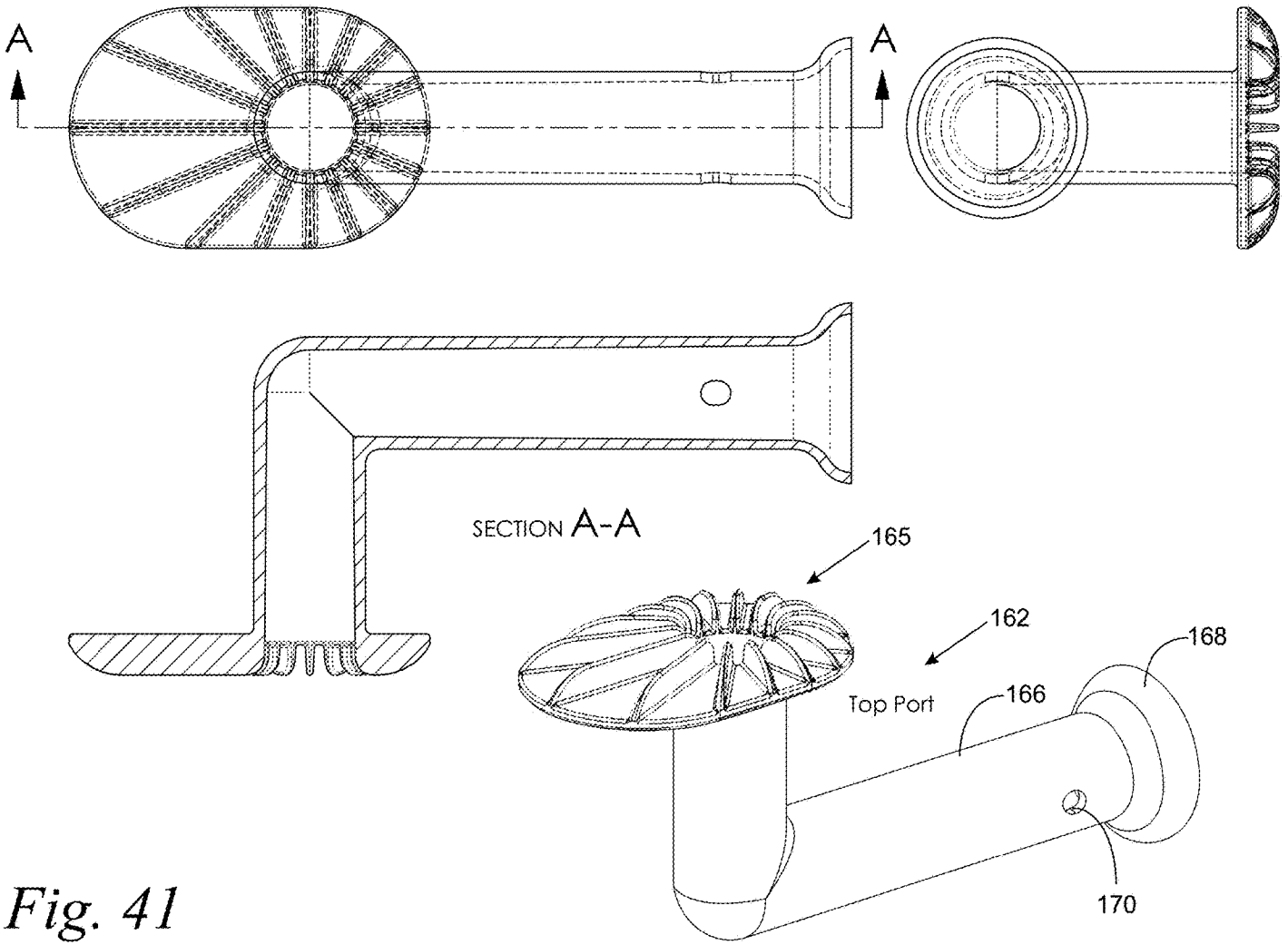
Figure 42:
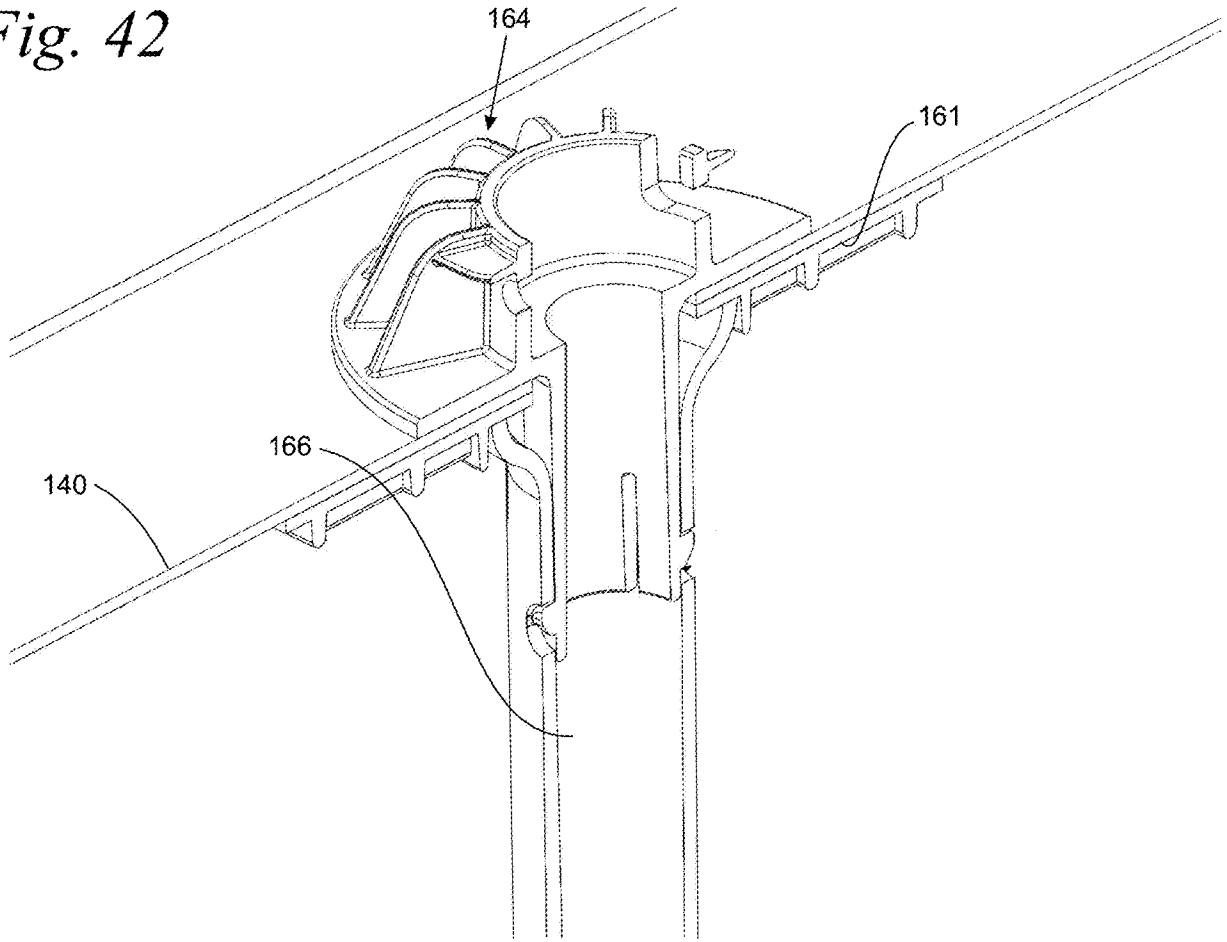
Figure 43:
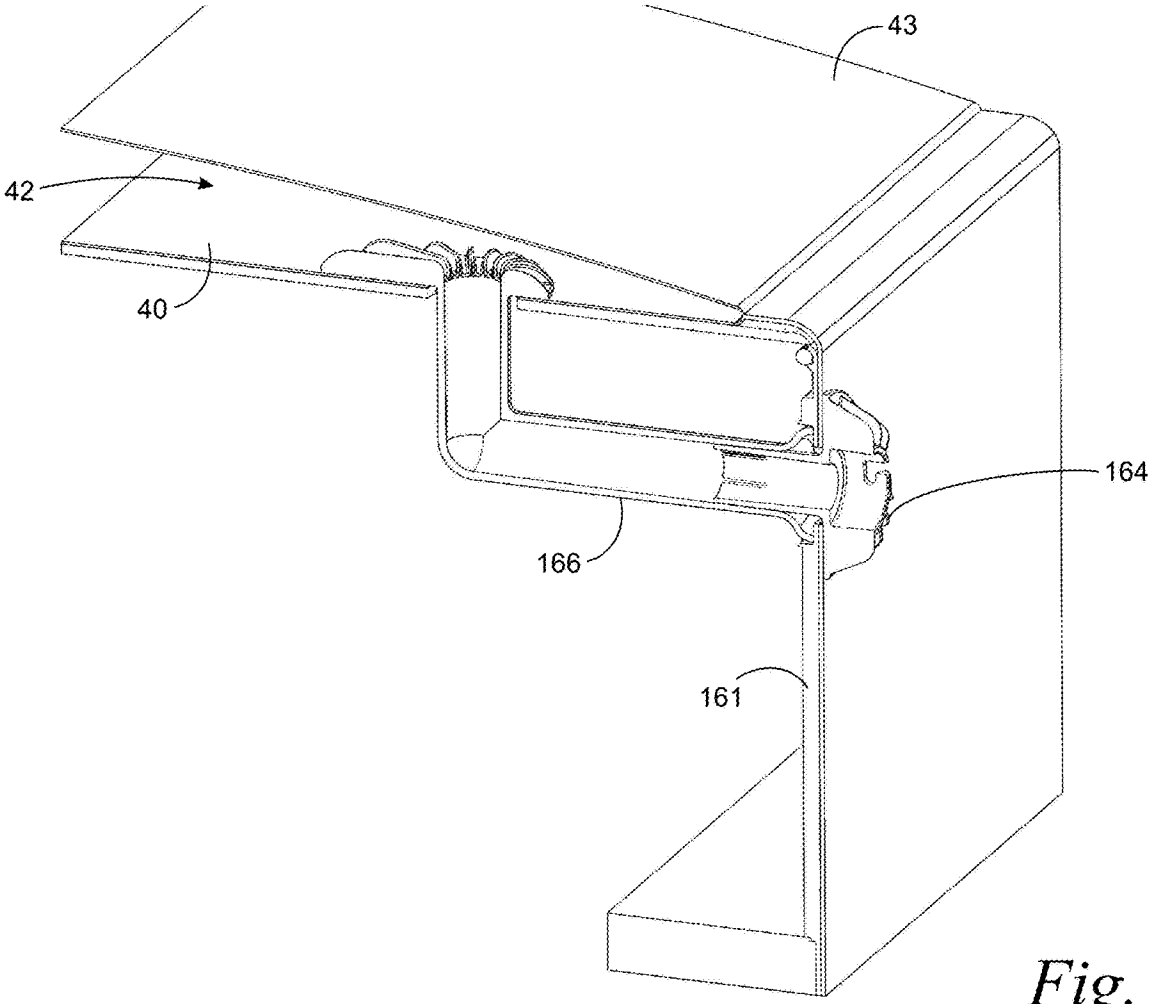
Figure 44:
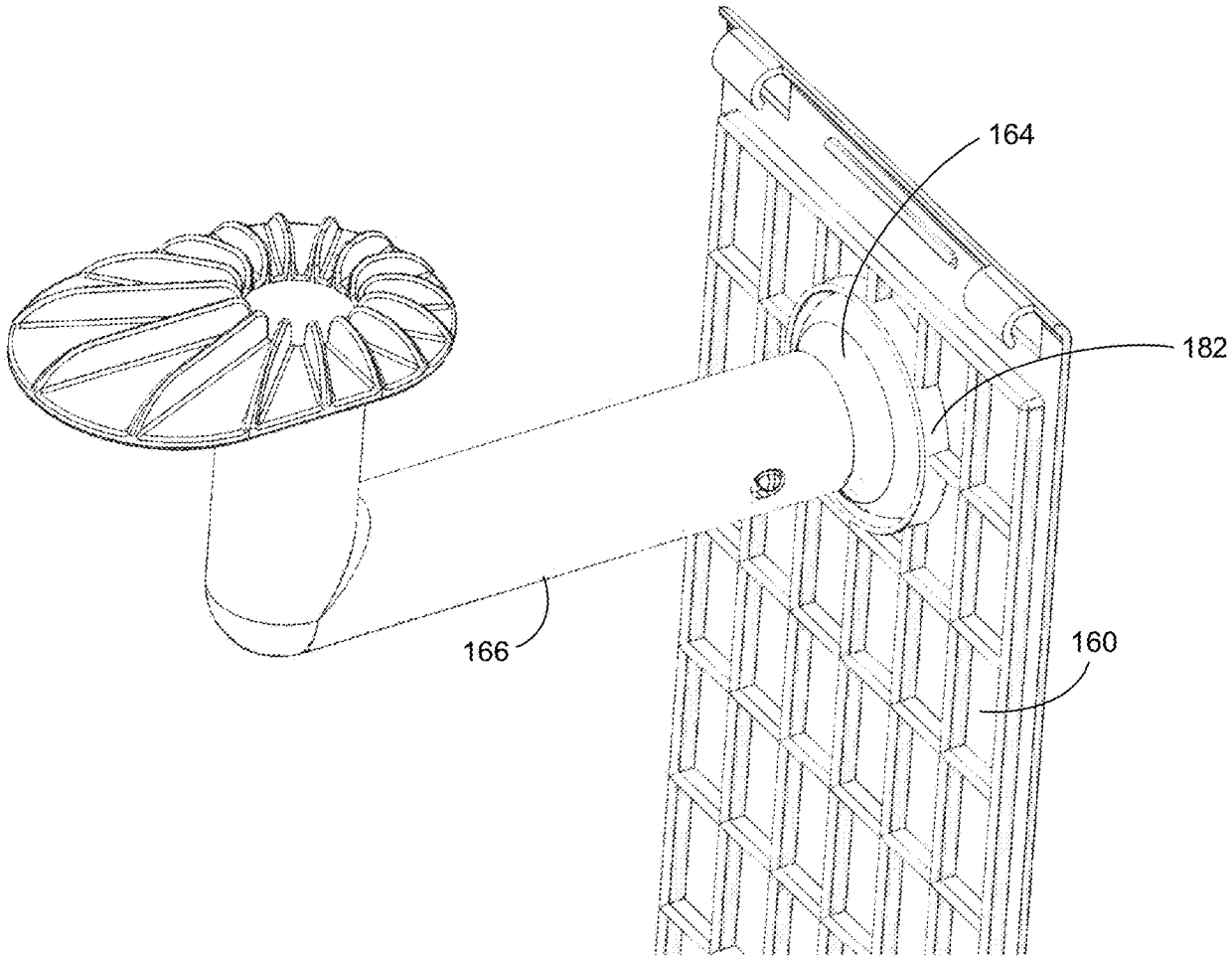
Figure 45:
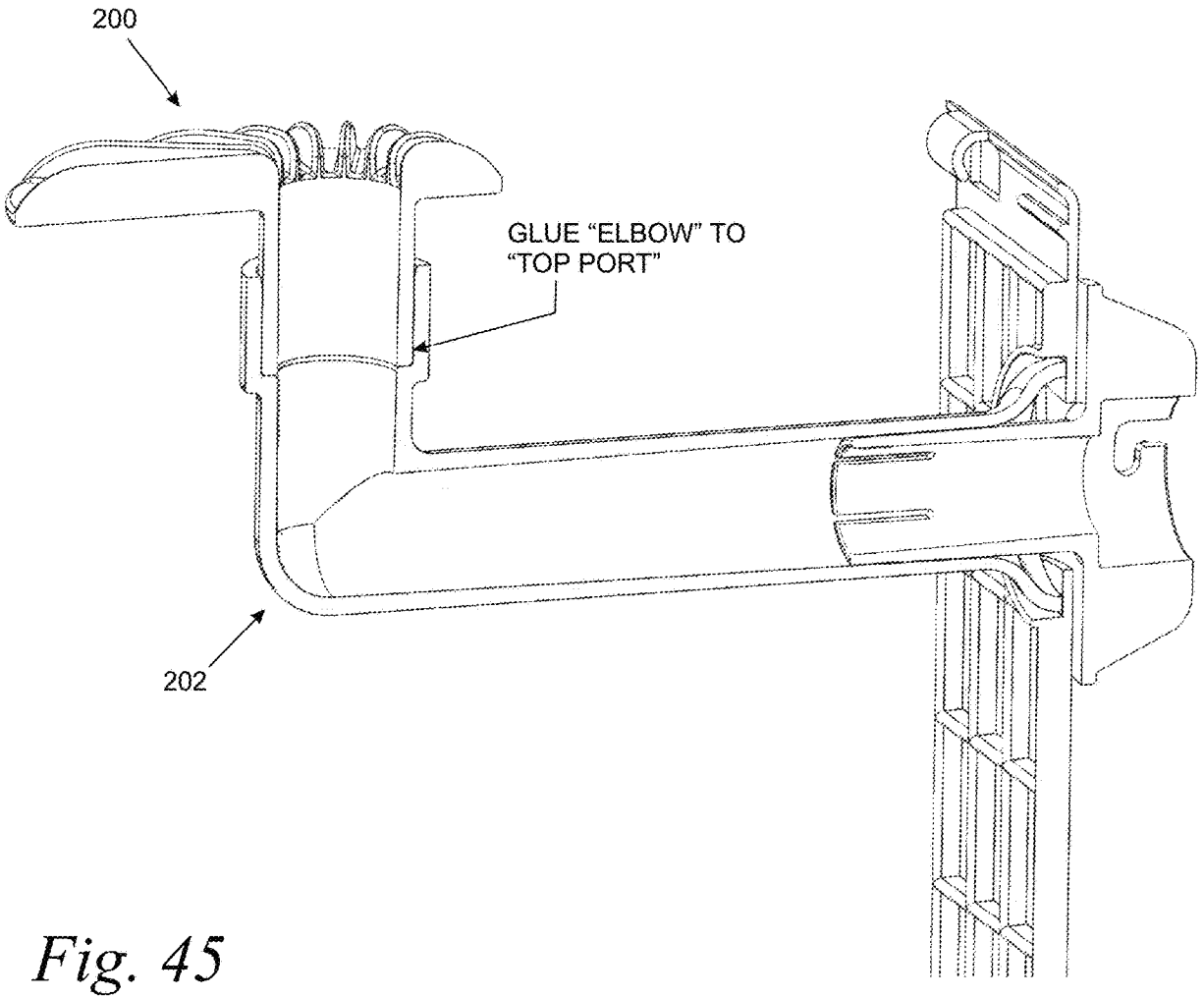
FIGS. 45-49 illustrate another alternate embodiment of the invention.
Figure 46:
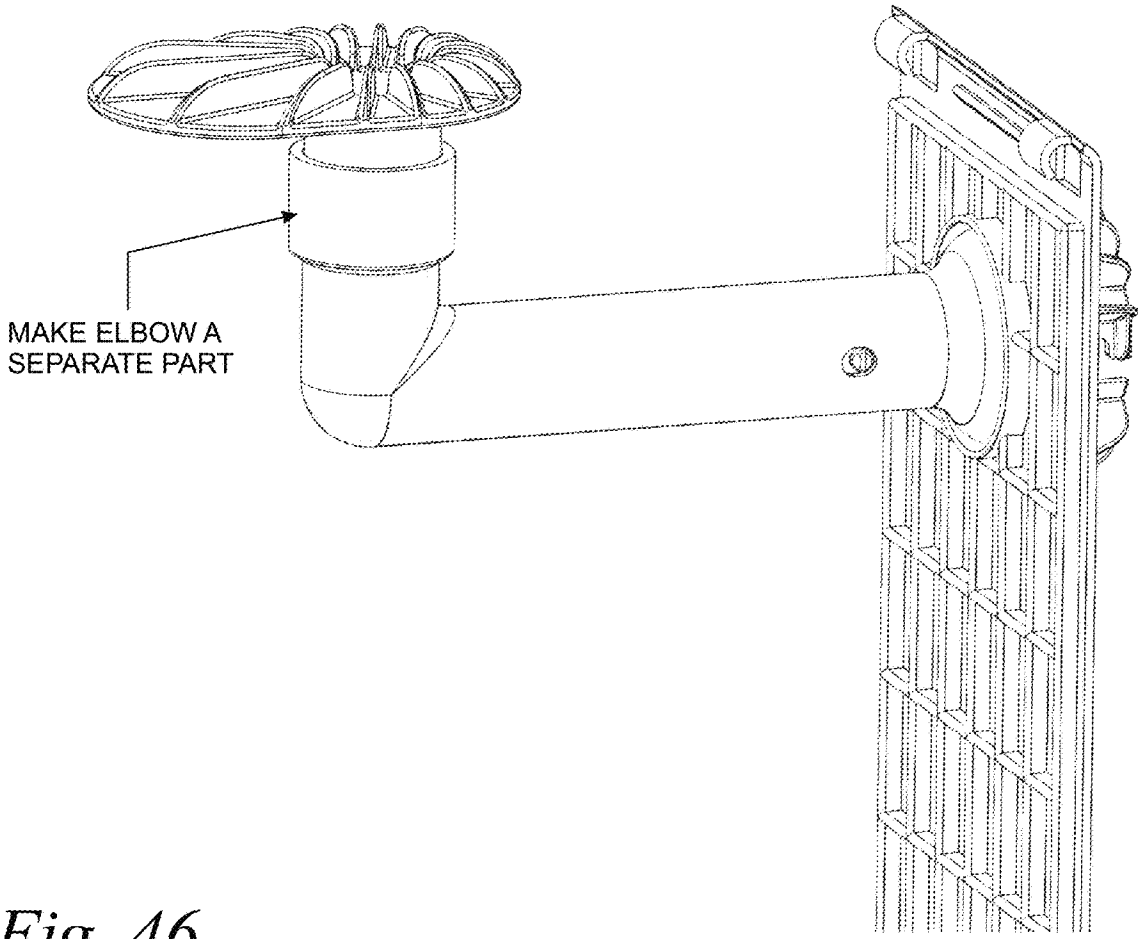
Figure 47:
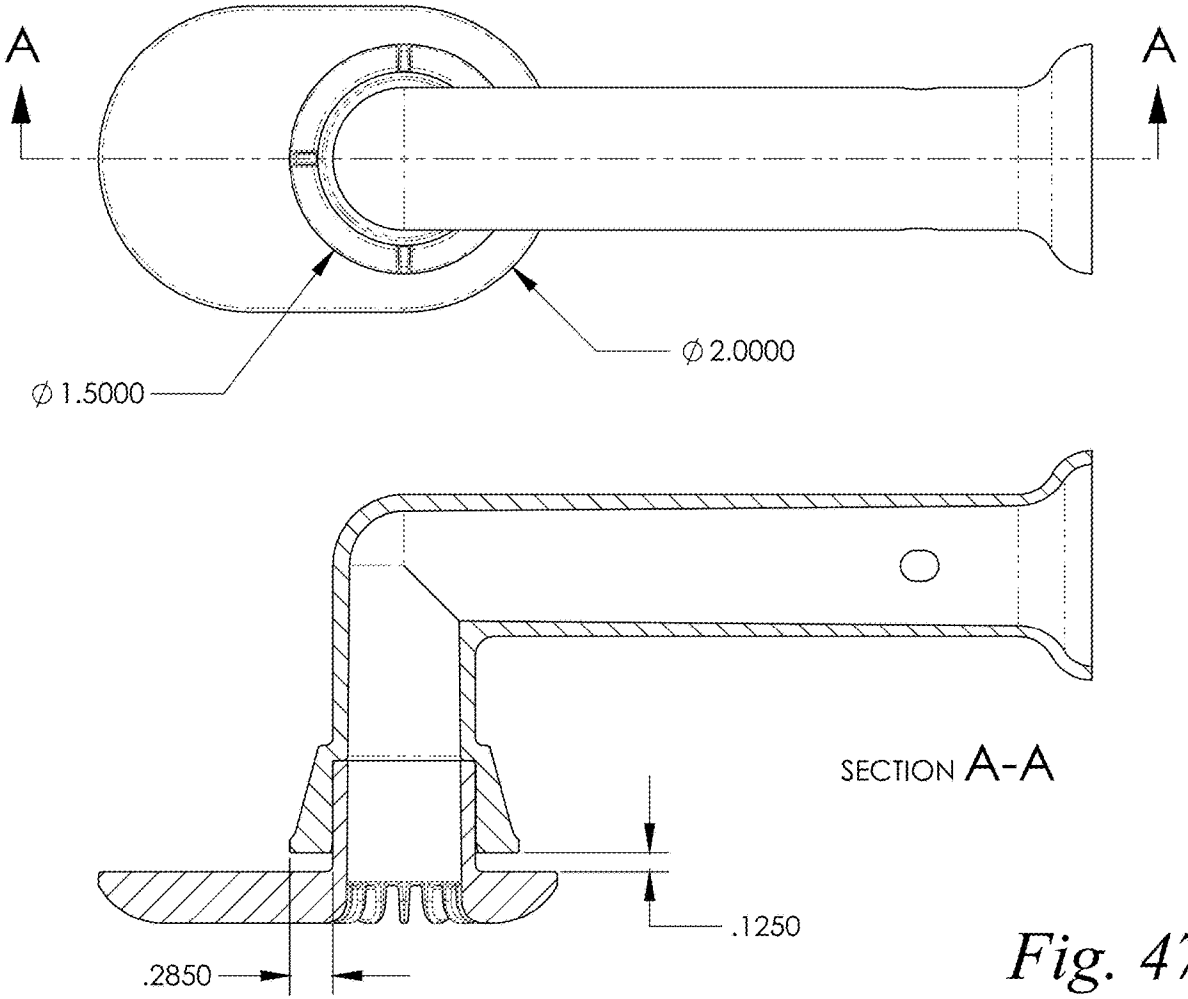
Figure 48:
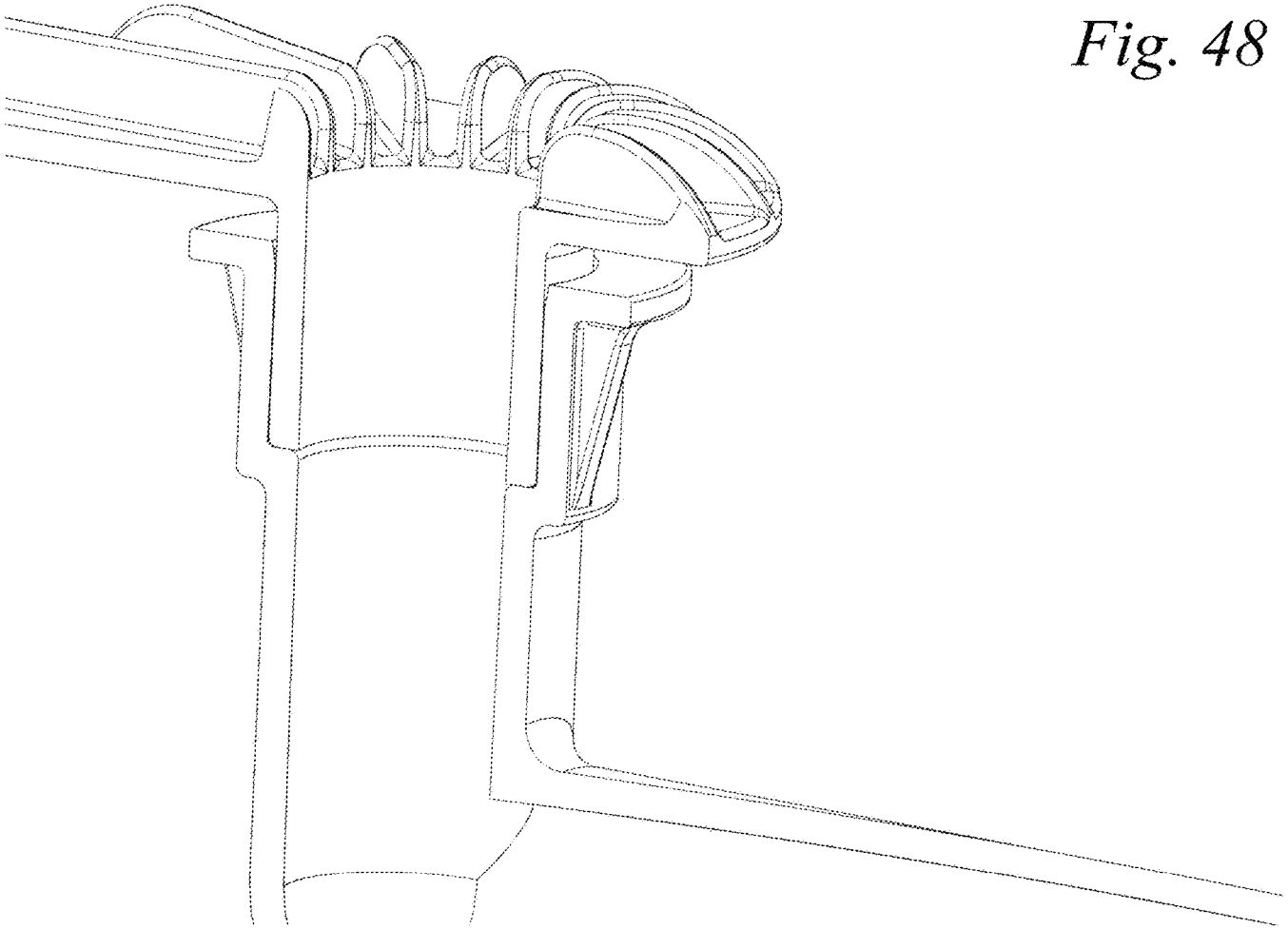
Figure 49:
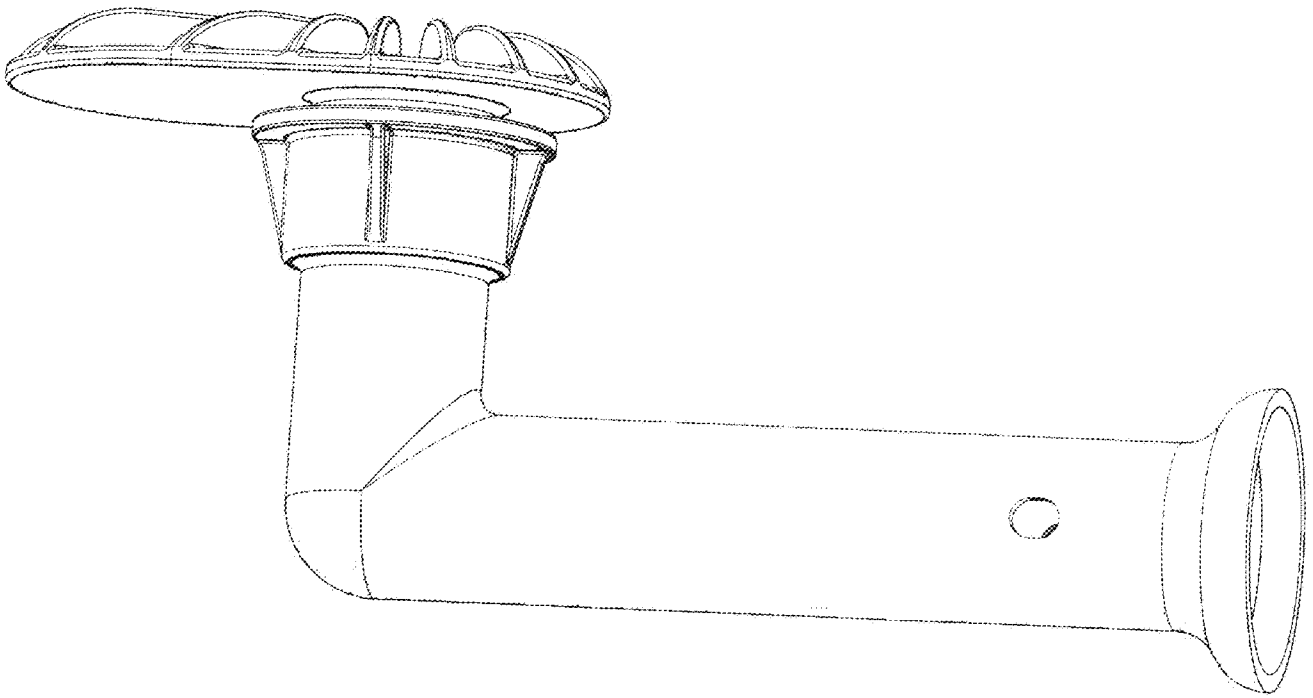

FIGS. 32-44 illustrate another embodiment of the invention that includes three components that are snapped together. These components consist of a stiffener plate 160 (FIG. 40). A combination top port and conduit 162 (FIG. 41) and a vertical wall port 164 (FIG. 39).

The combination top port and conduit 162 includes a top port portion 165, a conduit 166 with a 90° elbow and a flange 168. A through hole 176 is provided in order to lock the side wall port 164 (FIG. 39) in place.

The stiffener plate 160 (FIG. 40) includes a through hole, for example a square through hole, for receiving a nozzle portion 180 (FIG. 39) of the vertical wall port 164. An annular wall 182 is formed around the through hole 176. The stiffener plate 160 includes hooked tabs and is secured to a box spring as discussed above.

The combination top port and conduit 162 is fed into an aligned hole in a bottom layer 186 (FIG. 32) of an inflatable volume, as discussed above, and a top surface 118 of a foundation so that the top nozzle is on top of the bottom layer 40 of the inflatable volume. The flange portion 164 is disposed inside the annular wall 182 (FIG. 44) in the stiffener plate 160. The flange portion 164 is formed with a number of ribs 165 which allow air to escape into the inflatable volume even when the mattress (not shown) is resting on it.

The vertical wall port 164 is inserted in the through hole 182 (FIG. 40) of the stiffener plate 160. A button 188 (FIG. 39) formed on an internal nozzle 191 is received in the aperture 170 in the conduit portion 166 to secure all of the components together and may be attached to an elbow portion 202 by gluing.

FIGS. 45-49 illustrate another embodiment of the invention. This embodiment is formed from four components and is very similar to the embodiment illustrated in FIGS. 32-44. The major difference is that the top port 200 is formed as a separate component.

Obviously, many modifications and variations of the present invention are possible in light of the above teachings. Thus, it is to be understood that, within the scope of the appended claims, the invention may be practiced otherwise than as specifically described above.

I claim:

1. An improvement of a box spring having a frame and a plurality of vertical side walls and a top surface, the improvement comprising:

a stiffener plate rigidly attached to said box spring in a parallel relationship with one of said vertical side walls, said stiffener plate including an aperture;

a vertical wall fitting having a nozzle and a flange, said nozzle partially threaded on one end and formed to be received in said aperture in said stiffener plate, said nozzle further configured to receive a vertical wall threaded compression ring and further configured to be attached to an internal conduit on one end and an external air supply on an opposing end;

a vertical wall threaded compression ring for receiving said threaded portion of said nozzle in order to compress said flange of said vertical wall fitting against the stiffener plate;

a top surface fitting said including a nozzle and a flange, said nozzle for said top fitting configured to be received in an aperture formed in said top portion of said box spring and threaded on a first end for receiving a top surface compression ring and further configured to be attached to an internal conduit;

a first top surface compression ring for receiving said threaded first end of said nozzle in order to compress said flange of said top surface fitting relative to said top surface; and an internal conduit connected between said nozzles of said vertical wall fitting and said top surface fitting to enable a continuous air flow between said external air supply connected to said vertical wall fitting and said top surface fitting.

2. The improvement recited in claim 1, wherein said stiffener plate is attached to a frame of said box spring.

3. The improvement recited in claim 2, wherein said stiffener plate is attached to a frame of said box spring on one end.

4. The improvement recited in claim 3, wherein said stiffener plate is attached to a frame of said box spring on both ends.

5. The improvement recited in claim 1 wherein a second opposing end of said top surface nozzle is threaded and further includes a second top surface compression ring for receiving said second threaded end of said top surface nozzle, wherein said first compression ring and said second compression ring are configured to be disposed on opposing sides of said top surface of said box spring in order to apply compression forces relative to said flange and said top surface.

6. The improvement recited in claim 1 further including outwardly extending tabs from said stiffener plate that are configured to be received in notches formed in said flange of said vertical wall fitting to prevent rotation of the vertical wall nozzle from rotating within the aperture of the stiffener plate.

7. A box spring comprising:

a frame;

one or more wire frame assemblies carried by said frame;

a cover forming a plurality of vertical side walls attached to said frame;

a bottom layer of an inflatable bladder carried on top of said frame;

a top layer of said inflatable bladder;

an air inlet nozzle rigidly attached to said one of said vertical sidewalls, said air inlet nozzle configured to be connected to an external air supply;

an air exit nozzle carried by said bottom layer of said inflatable bladder; and a conduit for providing a continuous air communication path between said air inlet nozzle and said air exit nozzle which enables said inflatable bladder to be selectively inflated by said external air supply.

8. An assembly for attaching an external air supply to a vertical wall of a box spring, the assembly comprising:

a stiffener plate configured to be attached to a frame of a box spring, said plate formed with an aperture for receiving an internal nozzle portion of said nozzle; and a nozzle, said nozzle comprising:

a plate configured to be disposed on the outside of a vertical wall of a box spring, said plate including an aperture;

an external nozzle portion extending outwardly from said aperture on one side of said plate; and an internal nozzle portion extending inwardly from said aperture on an opposing side of said plate.

9. The assembly as recited in claim 8 further including:

a plurality of toothed studs extending outwardly from one side of said plate;

a plurality of through holes in said stiffener plate for receiving said toothed studs;

a plurality of ratchets formed on an interior portion of said stiffener plate, each of said ratchets disposed adjacent one of said through holes in order to cooperate with a toothed stud in order to secure said plate to said stiffener plate.

10. An improvement of a box spring having a frame and a plurality of vertical side walls and a top portion, the improvement comprising:

a stiffener plate rigidly attached to said box spring in a parallel relationship with one of said vertical side walls of said box spring, said stiffener plate including an aperture;

a vertical wall fitting having a nozzle and a flange, said nozzle partially threaded on one end and formed to be received in said aperture in said stiffener plate, said nozzle further configured to be attached to an internal conduit on one end and an external air supply on an opposing end;

a top surface fitting including a nozzle and a flange, said nozzle for said top fitting configured to be received in an aperture formed in said top portion of said box spring further configured to be attached to an internal conduit; and an internal conduit connected between said nozzles of said vertical wall fitting and said top surface fitting to enable a continuous air flow between said external air supply and said top surface fitting, wherein said vertical wall fitting is integrally formed is integrally formed with said internal conduit and said top surface fitting is formed as a separate fitting.

11. The improvement recited in claim 10, wherein said top surface fitting includes a plurality of outwardly extending ribs that allow air to escape into an inflatable volume even when the mattress is resting on it.

12. An improvement of a box spring having a frame and a plurality of vertical side walls and a top portion, the improvement comprising:

a stiffener plate rigidly attached to said box spring in a parallel relationship with a one of said vertical side walls of a said box spring, said stiffener plate including an aperture;

a vertical wall fitting having a nozzle and a flange, said nozzle partially threaded on one end and formed to be received in said aperture in said stiffener plate, said nozzle further configured to be attached to an internal conduit on one end and an external air supply on an opposing end;

a top surface fitting including a nozzle and a flange, said nozzle for said top fitting configured to be received in an aperture formed in said top portion of said box spring further configured to be attached to an internal conduit; and an internal conduit connected between said nozzles of said vertical wall fitting and said top surface fitting to enable a continuous air flow between said external air supply and said top surface fitting, wherein at least two of said vertical wall fitting, said top surface fitting and said conduit are configured to be snapped together.

13. A system for providing an air flow path to an inflatable bladder carried by a foundation, platform or box spring, the system comprising:

an internal conduit;

an air inlet disposed adjacent to a vertical sidewall of said foundation, platform or box spring said nozzle configured to be connected to an external air supply on one end and to said internal conduit on an opposing end;

an air outlet configured to be connected on one end to said internal conduit forming a continuous air flow path from said external air supply to said air outlet and configured on an opposing end to be disposed within an inflatable bladder.

14. The system as recited in claim 13, wherein said conduit includes a first portion connected on one end to said air inlet, said first portion being generally perpendicular to said vertical sidewall and a second portion connected on one end to said air outlet wherein said second portion is generally parallel to said vertical sidewall.

15. A system for providing an air flow path to an inflatable bladder carried by a foundation, platform or box spring from an external air supply, the system comprising:

an inflatable bladder having an upper layer and a bottom layer, wherein said bottom layer of said inflatable volume is integrally formed as a top layer of said foundation, platform or box spring; and a conduit to be in fluid communication with an air supply external to the foundation, platform, or platform on one end and further configured so that an opposing end of said conduit is received through said bottom layer of said inflatable bladder.

16. The system as recited in claim 15, wherein said conduit includes a 90° bend.

17. The system as recited in claim 15, further including an air exit port connected to said opposing end to enable air to escape into said inflatable volume even when the mattress is resting on it.

18. The system as recited in claim 17, further including a stiffener plate, said stiffener plate having an aperture for receiving said one end of said conduit.

19. The system as recited in claim 18, wherein said stiffener plate and said conduit are configured to snap together.

20. The system as recited in claim 15, further including an air exit port integrally formed on said opposing end of said conduit.

21. The system as recited in claim 15, further including an air nozzle integrally formed on said opposing end of said conduit.

* * * * *